US008160280B2

(12) United States Patent
Strauss et al.

(10) Patent No.: US 8,160,280 B2
(45) Date of Patent: Apr. 17, 2012

(54) APPARATUS AND METHOD FOR CONTROLLING A PLURALITY OF SPEAKERS BY MEANS OF A DSP

(75) Inventors: Michael Strauss, Ilmenau (DE); Michael Beckinger, Erfurt (DE); Thomas Roeder, Elxleben (DE); Frank Melchior, Ilmenau (DE); Gabriel Gatzsche, Martinroda (DE); Katrin Reichelt, Ilmenau (DE); Joachim Deguara, Ilmenau (DE); Martin Dausel, Ilmenau (DE); Renè Rodigast, Tautenhain (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 1071 days.

(21) Appl. No.: 11/995,153

(22) PCT Filed: Jul. 5, 2006

(86) PCT No.: PCT/EP2006/006569

§ 371 (c)(1),
(2), (4) Date: Mar. 12, 2008

(87) PCT Pub. No.: WO2007/009599

PCT Pub. Date: Jan. 25, 2007

(65) Prior Publication Data

US 2008/0219484 A1 Sep. 11, 2008

(30) Foreign Application Priority Data

Jul. 15, 2005 (DE) ..... 10 2005 033 238

(51) Int. Cl.
*H04R 5/02* (2006.01)
*H04R 5/00* (2006.01)

(52) U.S. Cl. ..... 381/300; 381/17; 700/94

(58) Field of Classification Search ..... 381/300, 381/303, 17, 18, 19, 58, 59; 700/94
See application file for complete search history.

(56) References Cited

U.S. PATENT DOCUMENTS 4,618,987 A 10/1986 Steinke et al.

(Continued)

FOREIGN PATENT DOCUMENTS

DE 26 05 056 A1 9/1976

(Continued)

OTHER PUBLICATIONS

Official communication issued in the International Application No. PCT/EP2006/006569, mailed on Oct. 2, 2006.

(Continued)

*Primary Examiner* — Edgardo San Martin
(74) *Attorney, Agent, or Firm* — Keating & Bennett, LLP

(57) ABSTRACT

In a reproduction environment, speakers are grouped in directional groups, wherein the directional groups overlap with respect to the associated speakers so that speakers are present which have a speaker parameter having different values for the first directional group and the second directional group. A controller for controlling a plurality of speakers has a provider for providing a source position of an audio source, wherein the source position is located between the first directional group position and the second directional group position. The apparatus further has a calculator for calculating a speaker signal for the at least one speaker, based on the first parameter value for the speaker parameter and based on the second parameter value for the speaker parameter.

16 Claims, 14 Drawing Sheets

AREA I: LS ONLY IN RGA
AREA II: LS ONLY IN RGB
AREA III: LS ONLY IN RGC
AREA IV: LS IN RGA, RGB
AREA V: LS IN RGA, RGC
AREA VI: LS IN RGB, RGC
AREA VII: LS IN RGA, RGB AND RGC

U.S. PATENT DOCUMENTS

| | | | | |
|---|---|---|---|---|
| 5,333,200 | A * | 7/1994 | Cooper et al. | 381/1 |
| 5,910,990 | A * | 6/1999 | Jang | 381/1 |
| 6,023,512 | A * | 2/2000 | Matsuo et al. | 381/17 |
| 6,498,857 | B1 * | 12/2002 | Sibbald | 381/310 |
| 6,507,658 | B1 | 1/2003 | Abel et al. | |
| 6,643,375 | B1 * | 11/2003 | Philp et al. | 381/1 |
| 7,684,578 | B2 * | 3/2010 | Roeder et al. | 381/310 |
| 7,706,544 | B2 * | 4/2010 | Melchior et al. | 381/18 |
| 7,751,915 | B2 * | 7/2010 | Roeder et al. | 700/94 |
| 7,801,313 | B2 * | 9/2010 | Sako et al. | 381/17 |
| 7,809,453 | B2 * | 10/2010 | Reichelt et al. | 700/94 |
| 2002/0048380 | A1 | 4/2002 | McGrath | |
| 2003/0179891 | A1 * | 9/2003 | Rabinowitz et al. | 381/103 |
| 2004/0223620 | A1 * | 11/2004 | Horbach et al. | 381/59 |
| 2006/0050897 | A1 * | 3/2006 | Asada et al. | 381/98 |
| 2006/0062411 | A1 * | 3/2006 | Sako et al. | 381/310 |
| 2006/0083382 | A1 * | 4/2006 | Sako et al. | 381/17 |
| 2006/0092854 | A1 * | 5/2006 | Roder et al. | 370/252 |
| 2006/0280311 | A1 * | 12/2006 | Beckinger et al. | 381/17 |
| 2007/0269062 | A1 * | 11/2007 | Rodigast et al. | 381/310 |
| 2008/0025534 | A1 * | 1/2008 | Kuhn et al. | 381/300 |
| 2008/0101620 | A1 * | 5/2008 | Horbach et al. | 381/59 |
| 2008/0192965 | A1 * | 8/2008 | Strauss et al. | 381/300 |
| 2008/0292112 | A1 * | 11/2008 | Valenzuela et al. | 381/97 |
| 2008/0298610 | A1 * | 12/2008 | Virolainen et al. | 381/307 |
| 2009/0087000 | A1 * | 4/2009 | Ko | 381/182 |
| 2009/0116652 | A1 * | 5/2009 | Kirkeby et al. | 381/1 |
| 2009/0129602 | A1 | 5/2009 | Konagai et al. | |
| 2009/0220111 | A1 * | 9/2009 | Deguara et al. | 381/300 |
| 2010/0305725 | A1 * | 12/2010 | Brannmark et al. | 700/94 |
| 2010/0328419 | A1 * | 12/2010 | Etter | 348/14.08 |
| 2010/0328423 | A1 * | 12/2010 | Etter | 348/14.16 |
| 2011/0135124 | A1 * | 6/2011 | Steffens et al. | 381/300 |

FOREIGN PATENT DOCUMENTS

| | | | |
|---|---|---|---|
| DE | 30 28 392 | A1 | 4/1981 |
| DE | 39 41 584 | C2 | 6/1990 |
| JP | 06-285258 | A | 10/1994 |
| JP | 06-289860 | A | 10/1994 |
| JP | 07-049694 | A | 2/1995 |
| JP | 07-231500 | A | 8/1995 |
| JP | 11-187498 | A | 7/1999 |
| JP | 2000-197198 | A | 7/2000 |
| JP | 2004-056168 | A | 2/2004 |
| JP | 2004-166212 | A | 6/2004 |
| JP | 2005-159518 | A | 6/2005 |
| JP | 2007-502590 | A | 2/2007 |
| WO | 2004/103022 | A3 | 11/2004 |

OTHER PUBLICATIONS

Whittacker:"Successful Sound Reinforcement in Arena Opera—A Case Study," Outboard Application Note; Jun. 19, 2003, [http://web.archive.org/web/20030619070028/http://www.outboard.co.uk/pdf/TiMaxapps/AppNoteButterfly.PDF].

Out Board Electronics Ltd.:"TiMax Level & Time Delay Audio Matrix," User Manual; Version 1.1, Jan. 16, 2003; pp. 1-38; Cambridge, England; [http://web.archive.org/web/20030901090806/http://www.outboard.co.uk/pdf/TiMaxinfo/TiMax+User+Manual.PDF].

Berkhout et al.: "Acoustic Control by Wave Field Synthesis," Journal of the Acoustical Society of America, AIP/Acoustical Society of America, vol. 93 No. 5, pp. 2764-2778, NY, US, May 1993.

Boone et al.: "Spatial Sound-Field Reproduction by Wave-Field Synthesis," Journal of the Audio Engineering Society, Audio Engineering Society, vol. 43, No. 12, Dec. 1995; pp. 1003-1012.

de Vries: "Sound Reinforcement by Wavefield Synthesis: Adaptation of the Synthesis Operator to the Loud Speaker Directivity Characteristics," Journal of the Audio Engineering Society, Audio Engineering Society, vol. 44, No. 12, Dec. 1996; pp. 1120-1131.

Michael Strauss et al., "Apparatus and Method for Controlling a Plurality of Speakers by Means of Graphical User Interface," U.S. Appl. No. 11/995,149, filed Jan. 9, 2008.

English language translation of Official Communication issued in corresponding Japanese Patent Application No. 2008-520759, mailed on Sep. 28, 2010.

* cited by examiner

AREA I: LS ONLY IN RGA
AREA II: LS ONLY IN RGB
AREA III: LS ONLY IN RGC
AREA IV: LS IN RGA, RGB
AREA V: LS IN RGA, RGC
AREA VI: LS IN RGB, RGC
AREA VII: LS IN RGA, RGB AND RGC

12 k=A, B, C (ij)=AB, AC, CB

| RG ID | | k | i | j | A | B | C |
|---|---|---|---|---|---|---|---|
| DELAY | | $D_k$ | $D_i$ | $D_j$ | $D_A$ | $D_B$ | $D_C$ |
| SCALE | | $S_k$ | $S_i$ | $S_j$ | $S_A$ | $S_B$ | $S_C$ |
| EQ FILTER | | $EQ_k$ | $EQ_i$ | $EQ_j$ | $EQ_A$ | $EQ_B$ | $EQ_C$ |

TABLE FOR SPEAKER IN: AREA I, II, III — AREA IV, V, VI — AREA VII

16a

FIGURE 2A

| | |
|---|---|
| AREA I, II, III | NO INTERPOLATION / MIX |
| AREA IV, V, VI | INTERPOLATION/MIX OF 2 VALUES |
| AREA VII | INTERPOLATION/MIX OF 3 VALUES |

FIGURE 2B

2-WAY FADE-OVER
(SOURCE IS ON CONNECTING LINE BETWEEN A AND C)

$S_1 = 1$: SPEAKER ONLY IN RGA
$S_2 = 1$: SPEAKER ONLY IN RGC $g_1 = (1\text{-Fade AbC})(1\text{-Fade AB})$; $LS_A = g_1 \cdot AS_A$
$g_2 = (1\text{-Fade AbC})\ \text{Fade AB}$; $LS_B = g_2 \cdot AS_B$
$g_3 = \text{Fade AbC}$ $LS_C = g_3 \cdot AS_C$

3-WAY FADE-OVER

TO THE SPEAKER CONTEMPLATED

InpathDual

InpathTriple

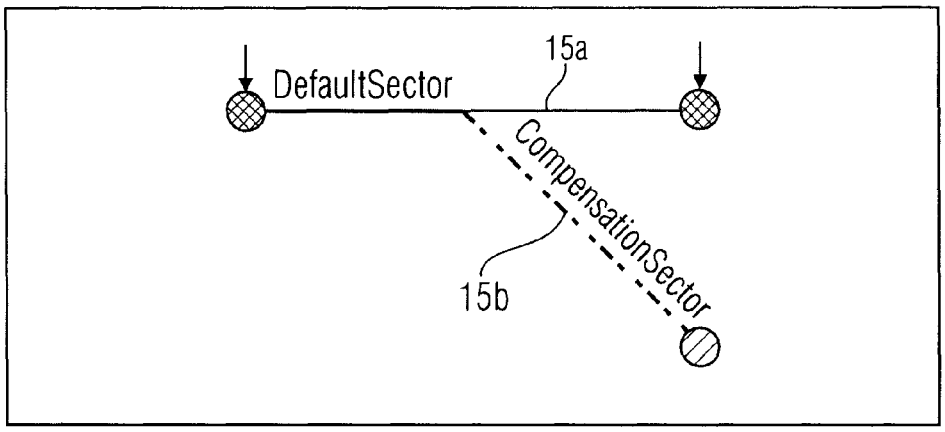
FIGURE 10A
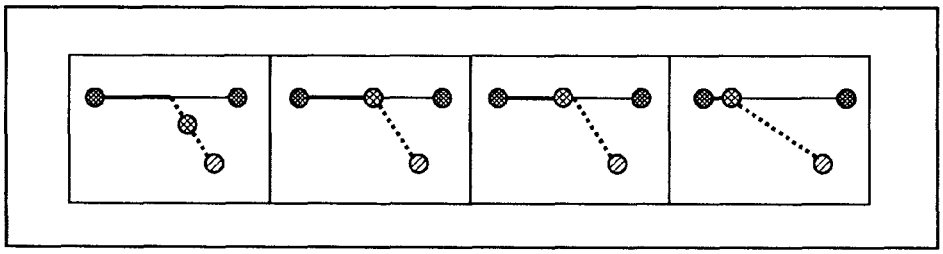
FIGURE 10B
GENERAL: FadeAC=(FadeAB+FadeAbC)/(FadeAB+1)
FadeAC = 0 (START OF THE PATH)
=> FadeAB=0
=> FadeAbC=0
FadeAC=1 (END OF THE PATH)
=> FadeAB=FadeAB
=> FadeAbC=1
FIGURE 10C 1. THE SOURCE IS LOCATED ON THE CompensationSector, IF:

$$FadeAC > (FadeAB) / (FadeAB+1)$$

2. THE SOURCE IS LOCATED ON THE DefaultSector, IF:

$$FadeAC <= (FadeAB) / (FadeAB+1)$$

3. IF THE SOURCE IS LOCATED ON THE DefaultSector, THEN:

$$FadeAbC = 0;$$
$$FadeAC = (FadeAB) / (FadeAB+1)$$
$$FadeAB = FadeAC / (1-FadeAC)$$

4. IF THE SOURCE IS LOCATED ON THE CompensationSector, THEN:

$$FadeAC = (FadeAB+FadeAbC) / (FadeAB+1)$$
$$FadeAbC = FadeAC*(FadeAB+1)-FadeAB$$

INPUT: FadeAC
OUTPUT: FadeAB, FadeAbC -> $g_1$, $g_2$, $g_3$

FIGURE 10D

APPARATUS AND METHOD FOR CONTROLLING A PLURALITY OF SPEAKERS BY MEANS OF A DSP

TECHNICAL FIELD

The present invention relates to audio technology, and in particular to positioning sound sources in systems comprising delta stereophony systems (DSS) or wave-field synthesis systems, or both systems.

BACKGROUND

Typical sonication systems for supplying a relatively large environment, such as in a conference room on the one hand, or a concert stage in a hall or even in the open air, on the other hand, all have the problem that a real-location reproduction of the sound sources has to be ruled out anyway because of the small number of speaker channels commonly used. But even if a left channel and a right channel are used in addition to the monochannel, the problem concerning the level still remains. For example, the back seats, i.e. the seats far remote from the stage, must obviously be supplied with sound just the same as the seats close to the stage. If, for example, speakers are arranged only at the front in the auditorium or at the sides of the auditorium, an inherent problem will be that persons sitting close to the speaker will perceive the speaker as excessively loud so that the persons at the very back will still be able to hear. In other words, due to the fact that individual supply speakers are perceived as point sources in such a sonication scenario, there will be persons who will claim that the sound is too loud, whereas the other persons will say that it is not loud enough. The persons for whom it is usually too loud will be those persons sitting very close to the point source-like speakers, whereas those persons for whom it is not loud enough will be seated far remote from the speakers.

To avoid this problem at least to some extent, an attempt has therefore been made to locate the speakers higher up, i.e. above the persons sitting close to the speakers, so that at least they will not be fully exposed to the full sound, but so that a considerable amount of the sound of the speaker will propagate above the heads of the audience and will therefore not be perceived by the members of the audience at the front, on the one hand, and will still provide a sufficient level for the members of the audience further at the back. In addition, this problem is met by linear array technology.

Other possibilities consist in running on low level so as not to put too much strain on the persons in the front rows, i.e. close to the speakers, so that there will then obviously be a risk that the sound again will not be loud enough further at the back in the room.

With regard to the directional perception, the whole issue is even more problematic. For example, a single monospeaker, for example in a conference room, will not enable directional perception. It will enable directional perception only if the location of the speaker corresponds to the direction. This is inherently due to the fact that there is only one single speaker channel. However, even if there are two stereo channels, one can, at the most, fade over, or cross-fade, between the left and right channels, i.e. one may conduct panning, as it were. This may be advantageous if there is only one single source. However, if there are several sources, the localization, as it is possible with two stereo channels, will only be roughly possible within a small area of the auditorium. Even though there is a directional perception even with stereo, this will only be the case in the sweet spot. With several sources, this directional impression will become more and more blurred, in particular as the number of sources increases.

In other scenarios, in such medium-sized to large auditoriums supplied with a mix of stereo or mono, the speakers are located above the audience, so that they will not be able to reproduce any directional information of the source anyway.

Even though the sound source, i.e., for example, a person speaking or a theatre actor, is on stage, he/she will be perceived from the speakers which are arranged laterally or centrally. In this context, natural directional perception has been dispensed with. One is already satisfied when the sound is sufficiently loud for the audience at the back and is not unbearably loud for the audience at the front.

In specific scenarios, so-called "support speakers" are also employed which are positioned in the vicinity of a sound source. In this manner, one tries to restore natural position finding on the part of the hearing sense. These support speakers are normally triggered without delay, while stereo sonication via the supply speakers is delayed, so that the support speaker is perceived first, and localization is made possible in accordance with the law of the first wave front. However, even support speakers exhibit the problem that they are perceived as a point source. On the one hand, this leads to there being a deviation from the actual position of the sound emitter, and also to there being a risk that for the audience at the front the sound will be all too loud again, whereas for the audience at the back, the sound will all be too low.

On the other hand, support speakers will enable real directional perception only if the sound source, i.e. for example a person speaking, is located in the immediate vicinity of the support speaker. This would work if a support speaker was built into the lectern and if a person speaking was standing at the lectern, and if in this reproduction space it was out of the question that anybody ever stood next to the lectern while performing for the audience.

With a positional deviation between the support speaker and the sound source, there will be an angular misalignment in the listener's directional perception which adds to the unease felt by members of the audience who might not be used to support speakers but are used to stereo reproduction. One has found that in particular when working with the law of the first wave front and when using a support speaker, it is better to deactivate the support speaker when the real sound source, i.e. the persons speaking, has moved too far away from the support speaker, for example. In other words, this issue is related to the problem that the support speaker cannot be moved, so that—in order not to create the above-mentioned unease among the audience—the support speaker is fully deactivated if the person speaking has moved too far away from the support speaker.

As has already been explained, support speakers employed are usually conventional speakers which in turn exhibit the acoustic properties of a point source—just like the supply speakers—which results in a level which is excessive in the immediate vicinity of the systems and is often perceived as unpleasant.

Generally, there is thus the goal of providing auditory perception of source positions for sonication scenarios as take place in the field of theatre/acting, the intention being that common normal sonication systems which are merely designed to adequately supply the entire auditorium with loudness be supplemented by directional speaker systems and their control.

Typically, medium-sized to large auditoriums are supplied with stereo or mono and, in some cases, with 5.1 surround technology. Typically, the speakers are located next to or above the members of the audience and are able to reproduce correct directional information of the sources for a small part of the audience only. Most members of the audience will get a wrong directional impression.

In addition, however, there are also delta stereophony systems (DSS) which generate directional reference in accordance with the law of the first sound wave front. DD 242954 A3 discloses a large-capacity sonication system for relatively large rooms and areas where the action or performance room and the reception or audience room are directly adjacent or are one and the same. Sonication is conducted in accordance with run-time principles. In particular, any misalignments and jump effects occurring with movements which represent a disturbance particularly in the case of important soloistic sound sources are avoided in that run-time staggering without any limited source areas is realized, and in that the sound power of the sources is taken into account. A control device connected to the delay or amplification means will control them by analogy with the sound paths between the source and acoustic-radiator locations. To this end, a position of a source is measured and used for adjusting speakers accordingly in terms of amplification and delay. A reproduction scenario includes several delimited speaker groups which are triggered respectively.

Delta stereophony results in that one or several directional speakers are located in the vicinity of the real sound source (e.g. on a stage), said directional speakers realizing a position finding reference in large parts of the area of the audience. An approximately natural directional perception is possible. These speakers are triggered after the directional speaker so as to realize the positional reference. In this way, the directional speaker will be perceived first, and thus, localization becomes possible, this connection also being referred to as the "law of the first wave front".

The support speakers are perceived as point sources. What results is a deviation from the actual position of the sound emitter, i.e. of the original source, if, e.g., a soloist is positioned at a distance from the support speaker rather than being directly in front of or next to the support speaker.

Therefore, if a sound source moves between two support speakers, one must fade over between such differently arranged support speakers. This relates both to the level and to time. By contrast, by means of wave-field synthesis systems, a real directional reference may be achieved via virtual sound sources.

In order to further understanding of the present invention, wave-field synthesis technology shall be explained below in more detail.

An improved natural spatial impression as well as enhanced enclosure in audio reproduction may be achieved using a new technology. The basics of this technology, the so-called wave-field synthesis (WFS), were researched at the technical university of Delft and introduced for the first time in the late eighties (Berkhout, A. J.; de Vries, D.; Vogel, P.: Acoustic control by Wave-field Synthesis. JASA 93, 1993).

Due to the enormous requirements placed upon computer power and transfer rates by this method, it is rare that wave-field synthesis has been applied in practice so far. It is the very progress made in the fields of microprocessor technology and audio encoding that nowadays allows this technology to be employed in specific applications. The first products in the professional field are expected to be introduced this year. In a few years' time, the first wave-field synthesis applications for the consumer domain are to enter the market.

The fundamental idea of WFS is based on the application of Huygens' principle of wave theory:

Each point at which a wave arrives is a starting point of an elementary wave which propagates as a spherical shape or as a circular shape.

In terms of acoustics, any shape of an incoming wave front may be replicated by a large number of speakers arranged next to one another (a so-called speaker array). In the simplest case of a single point source to be reproduced and a linear array of the speakers, the audio signals of each speaker must be fed with a time delay and an amplitude scaling in such a manner that the emitted sound fields of the individual speakers will superimpose correctly. In the case of several sound sources, for each source the contribution to each speaker is calculated separately, and the resulting signals are added. If the sources to be reproduced are located in a room having reflecting walls, reflections must also be reproduced via the speaker array as additional sources. The expenditure in calculation therefore highly depends on the number of sound sources, the reflection properties of the recording room, and the number of speakers.

The advantage of this technology is, in particular, that a natural spatial sound impression is possible across a large area of the reproduction room. Unlike the known technologies, the direction and distance of sound sources are reproduced in a highly precise manner. To a limited extent, virtual sound sources may even be positioned between the real speaker array and the listener.

Even though wave-field synthesis works well for environments the conditions of which are known, there will still be irregularities if the condition changes or if wave-field synthesis is performed on the basis of an environmental condition which does not match the actual condition of the environment.

An environmental condition may be described by the pulse response of the environment.

This will be set forth in more detail using the following example. One assumes that a speaker emits a sound signal toward a wall whose reflection is undesired. For this simple example, spatial compensation using wave-field synthesis would consist in that initially, the reflection of this wall is determined in order to ascertain the time when a sound signal that has been reflected by the wall arrives back at the speaker, and to ascertain the amplitude of the reflected sound signal. If the reflection from this wall is undesired, wave-field synthesis offers the possibility of eliminating the reflection from this wall in that a signal which is in phase opposition to the reflection signal and has a corresponding amplitude is impressed on the speaker in addition to the original audio signal, so that the forward compensation wave will extinguish the reflection wave such that the reflection from this wall is eliminated in the environment under consideration. This may be effected in that initially the pulse response of the environment is calculated, and that the condition and position of the wall are determined on the basis of the pulse response of this environment, the wall being interpreted as an image source, i.e. as a sound source reflecting an incoming sound.

If the pulse response of this environment is initially measured, and if the compensation signal which must be impressed on the speaker in a condition where it is superimposed on the audio signal is subsequently calculated, there will be a cancellation of the reflection from this wall, such that a listener in this environment will have the impression, in terms of sound, that this wall does not exist at all.

However, what is decisive for optimum compensation of the reflected wave is that the pulse response of the room is accurately determined so that no over- or undercompensation occurs.

Wave-field synthesis thus enables correct imaging of virtual sound sources across a large reproduction range. At the same time, it offers the sound mixer and the sound engineer a new technical and creative potential in creating even complex sound scenarios. Wave-field synthesis (WFS, or sound-field synthesis) as was developed at the technical university of Delft at the end of the eighties, represents a holographic approach of sound reproduction. The basis for this is the Kirchhoff-Helmholtz integral. It states that any sound fields may be generated within a closed volume by means of distributing monopole and dipole sound sources (speaker arrays) on the surface of this volume. For details, please see M. M. Boone, E. N. G. Verheijen, P. F. v. Tol, "Spatial Sound-Field Reproduction by Wave-Field Synthesis", Delft University of Technology Laboratory of Seismics and Acoustics, Journal of J. Audio Eng. Soc., vol. 43, No. 12, December 1995 and Diemer de Vries, "Sound Reinforcement by wave-field synthesis: Adaption of the Synthesis Operator to the Loudspeaker Directivity Characteristics", Delft University of Technology Laboratory of Seismics and Acoustics, Journal of J. Audio Eng. Soc., vol. 44, No. 12, December 1996.

In wave-field synthesis, a synthesis signal is calculated for each speaker of the speaker array from an audio signal which emits a virtual source at a virtual position, the synthesis signals being configured, with regard to amplitude and phase, such that a wave which results from the superposition of the individual sound wave emitted by the speakers existing in the speaker array corresponds to the wave that would be caused by the virtual source at the virtual position if this virtual source at the virtual position were a real source having a real position.

Typically, several virtual sources exist at different virtual positions. Calculation of the synthesis signals is performed for each virtual source at each virtual position, so that typically, a virtual source results in synthesis signals for several speakers. From the point of view of a speaker, this speaker thus receives several synthesis signals going back to different virtual sources. A superposition of these sources, which is possible due to the linear superposition principle, will then result in the reproduction signal actually emitted by the speaker.

The possibilities of wave-field synthesis may be exploited the better, the more closed the speaker arrays are, i.e. the more individual speakers can be positioned as close to one another as possible. However, as a consequence, the computing performance that a wave-field synthesis unit must achieve also increases, since typically channel information must also be taken into account. In particular, this means that in principle, a dedicated transfer channel is present from each virtual source to each speaker, and that in principle, it may be the case that each virtual source results in a synthesis signal for each speaker, or that each speaker receives a number of synthesis signals which equals the number of virtual sources.

In addition, it shall be noted at this point that the quality of the audio reproduction increases as the number of speakers made available increases. This means that the quality of the audio reproduction becomes better and more realistic as the number of speakers that are present in the speaker array(s) increases.

In the above scenario, the reproduction signals, which have been completely rendered and converted from analog to digital, for the individual speakers may be transferred, for example via two-wire lines, from the wave-field synthesis central unit to the individual speakers. Admittedly, this would have the advantage of almost ensuring that all speakers work synchronously, so that in this case, no further measures would be necessary for synchronization purposes. On the other hand, the wave-field synthesis central unit could only be produced, in each case, for a specific reproduction room, or for reproduction using a specific number of speakers. This means that for each reproduction room, a dedicated wave-field synthesis central unit would have to be produced that has to achieve a considerable amount of computing performance, since calculation of the audio reproduction signals must be effected at least partly in parallel and in real time, particularly with regard to a large number of speakers or a large number of virtual sources.

Delta stereophony is problematic in particular since positional artefacts will occur due to phase and level errors during fade-over between different sound sources. In addition, phase errors and mislocalization will occur in the case of different rates of movement of the sources. Moreover, fade-over from one support speaker to another support speaker is associated with a very large expenditure in terms or programming, there also being problems of keeping an overview of the entire audio scene, in particular when several sources are faded in and out by different support speakers, and when, in particular, there is a large number of support speakers which may be triggered differently.

In addition, wave-field synthesis, on the other hand, and delta stereophony, on the other hand, are actually opposite methods, while both systems may have advantages in different applications, however.

For example, delta stereophony is considerably less expensive in terms of calculating the speaker signals than is wave-field synthesis. On the other hand, working with wave-field synthesis may create no artefacts. However, because of the space requirement and the requirement placed upon an array having closely spaced speakers, wave-field synthesis arrays cannot be employed everywhere. In particular in the field of stage technique, it is very problematic to position a speaker band or a speaker array on stage, since it is difficult to hide such speaker arrays, and since they will therefore be visible and negatively affect the visual impression of the stage. This is problematic, in particular, when—as it usually is the case in theater/musical performances—the visual impression of a stage has priority over all other issues, and in particular over the sound or sound production. On the other hand, no fixed grid of support speakers is predefined by wave-field synthesis, but there may be continuous movement of a virtual source. A support speaker, however, cannot move. However, the movement of a support speaker may be created virtually by directional fade over.

Limitations of delta stereophony thus consist in that, in particular, the number of possible support speakers accommodated on a stage is limited for reasons of expenditure (depending on the stage setting) and for reasons of sound management. In addition, each support speaker necessitates, if it is to work in accordance with the principle of the first wave front, further speakers which create the necessary loudness. This is the very advantage of delta stereophony, mainly that a relatively small speaker, which is consequently easy to accommodate, is sufficient for localization generation, whereas a large number of further speakers located in the vicinity serve to create the necessary loudness for the member of the audience who, in a relatively auditorium, may actually be seated quite far at the back.

Therefore, all speakers on the stage may be associated with different directional zones, each directional zone having a localization speaker (or a small group of localization speakers triggered at the same time) triggered without any or with only a small delay, while the other speakers of the directional group are triggered with the same signal, but with a time delay, so as to generate the necessary loudness, while the localization speaker would have supplied the specifically designed localization.

Since sufficient loudness is needed, the number of speakers in a directional group may not be reduced to any value desired. On the other hand, one would like to have a very large number of directional zones to at least aim at a continuous supply of sound. Due to the fact that in addition to the localization speaker, each directional zone also necessitates a sufficient number of speakers to generate sufficient loudness, the number of directional zones is limited when a stage area is divided up into mutually adjacent, non-overlapping directional zones, each directional zone having a localization speaker or a small group of closely spaced adjacent localization speakers associated with it.

Typical delta stereophony concepts are based on that fade-over is performed between two locations if a source is to move from one location to another location. This concept is problematic when, for example, a manual intervention is to be performed in a programmed setup, or when an error correction is to occur. For example, if it turns out that a singer does not stick to the agreed route across the stage, but moves differently, there will be an increasing deviation between the perceived position and the actual position of the singer, which evidently is not desirable.

If for such a case a possibility of corrective intervention is desired, a user could input, for correction purposes, that the audio position is to correspond, at a specific point in time or directly, with the actual position of the singer on stage. However, this would result in a hard source jump which might possibly lead to even larger artefacts than the mismatch between the audio source and the audio source perceived.

In order to avoid such a jump, one might complete the fade-over process one has already started so as to then correct the target of the next fade-over process starting from a position within a directional zone, i.e. after a complete fade-over process. This would ensure that not hard jumps will occur. What is disadvantageous about this concept, however, is that there is no possibility of intervening during a fade-over process. Thus, a considerable delay will result, particularly when a relatively long fade-over process is ongoing, namely, for example, from a source on the very left of the stage to a source on the very right of a large stage. This results in that there is a relatively long time interval where the perceived position of the audio source deviates from the actual one. In addition, the actual position, which might already be moving again, must obviously be caught up with, which may only be accomplished by a relatively fast passage of a source across the stage to the position sought. This very fast passage may, in turn, lead to artefacts, or at least result in that a user asks himself/herself why the audio position perceived is moving so much even though the singer himself/herself has not moved or has moved only very little.

SUMMARY

According to an embodiment, an apparatus for controlling a plurality of speakers grouped into at least three directional groups, each directional group having a directional group position associated with it, may have a source path receiver for receiving a source path from a first directional group position to a second directional group position, and movement information for the source path; a source path parameter calculator for calculating a source path parameter for different points in time on the basis of the movement information, the source path parameter indicating a position of an audio source on the source path; a path modification command receiver for receiving a path modification command by means of which a compensation path to the third directional zone may be initiated; a storer for storing a value of the source path parameter at a location where the compensation path deviates from the source path; and weighting factor calculator for calculating weighting factors for the speakers of the three directional groups on the basis of the source path, the stored value of the source path parameter, and information on the compensation path.

According to another embodiment, a method for controlling a plurality of speakers grouped into at least three directional groups, each directional group having a directional group position associated with it, may have the steps of: receiving a source path from a first directional group position to a second directional group position, and movement information for the source path; calculating a source path parameter for different points in time on the basis of the movement information, the source path parameter indicating a position of an audio source on the source path; receiving a path modification command by means of which a compensation path to the third directional zone may be initiated; storing a value of the source path parameter at a location where the compensation path deviates from the source path; and calculating weighting factors for the speakers of the three directional groups on the basis of the source path, the stored value of the source path parameter, and information on the compensation path.

According to another embodiment, a computer program may have a program code for performing the method for controlling a plurality of speakers grouped into at least three directional groups, each directional group having a directional group position associated with it, the method having the steps of: receiving a source path from a first directional group position to a second directional group position, and movement information for the source path; calculating a source path parameter for different points in time on the basis of the movement information, the source path parameter indicating a position of an audio source on the source path; receiving a path modification command by means of which a compensation path to the third directional zone may be initiated; storing a value of the source path parameter at a location where the compensation path deviates from the source path; and calculating weighting factors for the speakers of the three directional groups on the basis of the source path, the stored value of the source path parameter, and information on the compensation path, when the computer program runs on a computer.

The present invention is based on the finding that an artefact-reduced and fast possibility of manual intervention in the course of the movement of sources is achieved in that a compensation path is allowed on which a source may move. The compensation path differs from the normal source path in that it does not start at a directional group position, but starts at a connecting line between two directional groups, namely at any point of this connection line, and extends from there to a new directional target group. In this way, it is no longer possible to describe a source by indicating two directional groups, but the source must be described by at least three directional groups, in an advantageous embodiment of the present invention, a positional description of the source comprising an identification of the three directional groups involved as well as two fading factors, the first fading factor indicating where a "turn" has been made on the source path, and the second fading factor indicating where exactly the source is being positioned on the compensation path, i.e. how far the source is already removed from the source path, or for how long the source must still move before it reaches the new target direction.

Calculation of the weighting factors for the speakers of the three directional zones involved takes place, in accordance with the invention, on the basis of the source path, the stored value of the source path parameter, and information on the compensation path. The information on the compensation path may include the new target per se or the second fading factor. In addition, a predefined speed may be used for the movement of the source on the compensation path, which predefined speed may be a default speed in the system, since the movement on the compensation path is typically a compensation movement which does not depend on the audio scene, but is intended to change or correct something in a pre-programmed scene. For this reason, the movement of the audio source on the compensation path will be typically relatively fast, but not sufficiently fast for problematic audible artefacts to occur.

In an advantageous embodiment of the present invention, the means for calculating the weighting factors is configured to calculate weighting factors which linearly depend on the fading factors. Alternative concepts, such as non-linear dependencies in terms of a $\text{sine}^2$ function or a $\text{cosine}^2$ function may also be used, however.

In an advantageous embodiment of the present invention, the apparatus for controlling a plurality of speakers further comprises a jump compensation means which advantageously operates hierarchically on the basis of different compensation strategies made available in order to avoid a hard source jump by means of a jump compensation path.

An advantageous embodiment is based on that one needs to leave behind the mutually adjacent directional zones which specify the "grid" of the points of movement on a stage which are easy to localize. Because of the requirement that the directional zones be non-overlapping, in order to have clear-cut conditions in the triggering, the number of directional zones was limited, since in addition to the localization speaker, each directional zone also necessitated a sufficiently large number of speakers so as to also generate sufficient loudness in addition to the first wave front, which is generated by the localization speaker.

Advantageously, the stage area is divided up into mutually overlapping directional zones, a situation thus being created where a speaker may not only belong to one single directional zone, but to a plurality of directional zones, i.e., for example, to at least the first directional zone and the second directional zone, and possibly to a third or a further fourth directional zone.

A speaker will learn about its affiliation with a directional zone in that it has, if belongs to a directional zone, a specific speaker parameter associated with it which is determined by the directional zone. Such a speaker parameter may be a delay which will be small for the localization speakers of the directional zone, and will be larger for the other speakers of the directional zone. A further parameter may be a scaling or a filter curve which may be determined by a filter parameter (equalizer parameter).

In this context, each speaker on a stage will typically have a speaker parameter of its own, irrespective of which directional zone it belongs to. These values of the speaker parameters, which depend on the directional zone the speaker belongs to, are typically specified, in a partially heuristic and partially empirical manner, for a specific room by a sound engineer during a sound check, and are employed once the speaker operates.

However, since one allows a speaker to belong to several directional zones, the speaker has two different speaker parameter values. For example, a speaker would have a first delay DA if it belongs to the directional zone A. However, the speaker would have a different delay value DB if it belongs to the directional zone B.

If a switch is to be made from the directional group A to a directional group B, or if a position of a sound source located between the directional zone position A of the directional group A and the directional zone position B of the directional group B is to be reproduced, the speaker parameters are now used to use the audio signal for this speaker and for the audio source under consideration. In a accordance with the invention, the contradiction which is actually insoluble, namely that a speaker has two different delay settings, scaling settings or filter settings, is solved in that for calculating the audio signal to be emitted by the speaker, the speaker parameter values for all directional groups involved are used.

Advantageously, calculation of the audio signal depends on the measure of distance, i.e. on the spatial position between the two directional group positions, the measure of distance typically being a factor between zero and one, a factor of zero determining that the speaker is located at the directional group position A, whereas a factor of one determines that the speaker is at the directional group position B.

In an advantageous embodiment of the present invention, a genuine speaker parameter value interpolation is performed, or an audio signal based on the first speaker parameter is faded to a speaker signal based on the second speaker parameter, as a function of the speed with which a source moves between the directional group position A and the directional group position B. Particularly with delay settings, i.e. with a speaker parameter which reproduces a delay of the speaker (relative to a reference delay), particular care must be taken to see whether interpolation or fade-over is employed. If, namely, in the case of a very fast movement of a source, interpolation is employed, this will lead to audible artefacts which will lead to a tone which increases fast in loudness or decreases fast in loudness. For fast movements of sources, fade-over is therefore advantageous, which admittedly leads to comb filter effects which, however, are not or hardly audible because of the fast fade-over. On the other hand, for slow movement speeds, interpolation is advantageous in order to avoid the comb filter effects which occur with slow fade-overs and which additionally become clearly audible. In order to avoid further artefacts such as cracking sound, which would be audible, during the "switchover" from interpolation to fade-over, the switchover is not performed abruptly, i.e. from one sample to the next, but a fade-over is performed within a fade-over area, which will include several samples, on the basis of a fade-over function which is advantageously linear, but may also be non-linear, for example trigonometrical.

In a further advantageous embodiment of the present invention, a graphical user interface is made available on which paths of a sound source from a directional zone to another directional zone are graphically shown. Advantageously, compensation paths are also taken into account so as to allow fast changes of the path of a source, or to avoid hard jumps of sources as may occur at scene changes. The compensation path ensures that a path of a source may not only be changed if the source is located at the directional position, but even if the source is located between two directional positions. This ensures that a source may also turn off from its programmed path in between two directional positions. In other words, this is achieved in particular in that the position of a source may be defined by three (adjacent) directional zones, and particularly by identifying the three directional zones as well as by indicating two fading factors.

In a further advantageous embodiment of the present invention, a wave-field synthesis array is arranged in the sonication room where wave-field synthesis speaker arrays are possible, said wave-field synthesis array also representing, by indicating a virtual position (e.g. in the center of the array), a directional zone with a directional zone position.

Thus, the user of the system is relieved of making the decision whether a sound source is a wave-field synthesis sound source or a delta stereophony sound source.

Thus, a user-friendly and flexible system is provided which enables flexible division of a room into directional groups, since overlaps of directional groups are allowed, speakers within such an overlap region being supplied, with regard to their speaker parameters, by speaker parameters derived from the speaker parameters belonging to the directional zones, this derivation advantageously being effected by means of interpolation or fade-over. Alternatively, a hard decision may also be made, for example to take the one speaker parameter if the source is closer to one specific directional zone, so as to then take the other speaker parameter when the source is located closer to the other directional zone, in which case the hard jump which would occur in this case could simply be smoothed for artefact reduction purposes. However, distance-controlled fade-over or distance-controlled interpolation is advantageous.

BRIEF DESCRIPTION OF THE DRAWINGS

Embodiments of the present invention will be detailed subsequently referring to the appended drawings, in which:

FIG. 2*a* shows a schematic speaker parameter table for speakers in the various areas;

FIG. 2*b* shows a more specific representation of the steps for the various areas which are needed for speaker parameter processing;

FIG. 10*a* is a representation for defining the source path (DefaultSector) and the compensation path (CompensationSector);

FIG. 10*b* is a schematic representation of the backward movement of a source using the Cader, a modified compensation path being present;

FIG. 10*c* is a representation of the effect of FadeAC on the other fading factors;

FIG. 10*d* is a schematic representation for calculating the fading factors and, thus, the weighting factors as a function of FadeAC;

DETAILED DESCRIPTION

Figure 1:
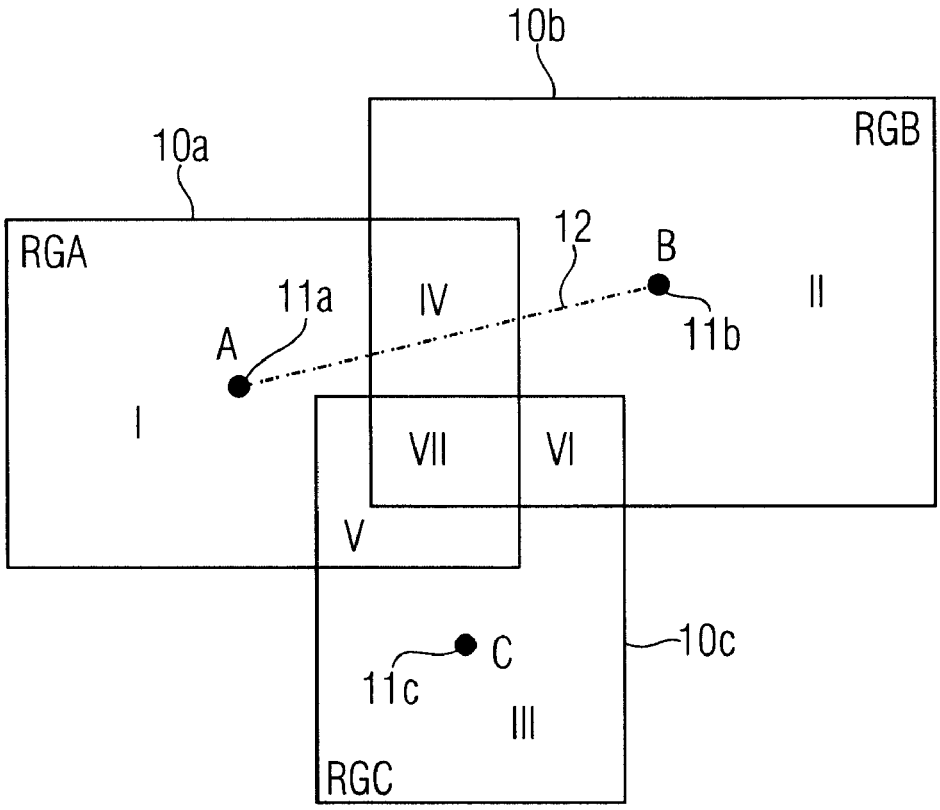
FIG. 1 shows a subdivision of a sonication room into overlapping directional groups.

FIG. 1 shows a schematic representation of a stage area divided up into three directional zones RGA, RGB, and RGC, each directional zone comprising a geometrical area 10*a*, 10*b*, 10*c* of the stage, the area boundaries not being critical. Critical is only whether speakers are located in the various areas shown in FIG. 1. In the example shown in FIG. 1, speakers located in the area I only belong to the directional group A, the position of the directional group A being indicated at 11*a*. By definition, the directional group RGA is allocated the position 11*a*, where the speaker of the directional group A is advantageously located which, in accordance with the law of the first wave front, has a delay which is smaller than the delays of all other speakers associated with the directional group A. In the area II, there are speakers which are associated only with the directional group RGB which, by definition, has a directional group position 11*b* where the support speaker of the directional group RGB is located which has a smaller delay than all other speakers of the directional group RGB. In an area III, in turn, there are only speakers associated with the directional group C, the directional group C by definition having a position 11*c* where the support speaker of the directional group RGC is arranged which will send with a shorter delay than all the other speakers of the directional group RGC.

In addition, in the subdivision of the stage area into directional zones, shown in FIG. 1, there is an area IV which has speakers arranged therein which are associated both with the directional group RGA and with the directional group RGB. Accordingly, there is an area V which has speakers arranged therein which are associated both with the directional group RGA and with the directional group RGC.

Moreover, there exists an area VI having speakers arranged therein which are associated both with the directional group RGC and with the directional group RGB. Finally, there is an area of overlap between all three directional groups, this area of overlap VII comprising speakers which are associated both with the directional group RGA and with the directional group RGB and with the directional group RGC.

Typically, each speaker in a stage setting has a speaker parameter or a plurality of speaker parameters associated with it by the sound engineer, or by the director responsible for the sound. As is shown in column 12 in FIG. 2*a*, these speaker parameters comprise a delay parameter, a scale parameter, and an EQ filter parameter. The delay parameter D indicates the amount of delay of an audio signal, output by this speaker, with regard to a reference value (which applies to a different speaker but need not necessarily exist in real terms). The scale parameter indicates the amount of amplification or attenuation of an audio signal, output by this speaker, as compared with a reference value.

The EQ filter parameter indicates what the frequency response of an audio signal which is output by a speaker is to be like. There might be a desire, for specific speakers, to amplify the high frequencies as compared with the low frequencies, which would make sense, for example, if the speaker is located in the vicinity of a part of the stage which comprises a strong low-pass characteristic. On the other hand, for a speaker located in a stage area having no low-pass characteristic, there might be a desire to introduce such a low-pass characteristic, in which case the EQ filter parameter would indicate a frequency response wherein the high frequencies are attenuated relative to the low frequencies. Generally, any frequency response may be adjusted for each speaker via an EQ filter parameter.

There is only one single delay parameter Dk, scale parameter Sk, and EQ filter parameter Eqk for all speakers located in the areas I, II, III. Whenever a directional group is to be active, the audio signal for a speaker in the areas I, II, III is simply calculated while taking into account the respective speaker parameter(s).

However, if a speaker is located in the areas IV, V, VI, each speaker has two associated speaker parameter values for each speaker parameter. If, for example, only the speakers in the directional group RGA are active, i.e. if a source is positioned, for example, precisely at the directional group position A (11*a*), only the speakers of the directional group A for this audio source will be playing. In this case, that column of parameter values which is associated with the directional group RGA would be used for calculating the audio signal for the speaker.

However, if the audio source is located precisely at the position 11*b* in the directional group RGB, only that plurality of parameter values which are associated with the directional group RGB would be used when an audio signal for the speaker is calculated.

If an audio source is located between the sources AB, however, i.e. at any point on the connecting line between 11*a* and 11*b* in FIG. 1, this connecting line being designated by 12, all speakers existing in the areas IV and III would comprise contradictory parameter values.

In accordance with the invention, the audio signal is now calculated while taking into account both parameter values, and advantageously while taking into account the measure of distance, as will be set forth below. Advantageously, an interpolation or fade-over is performed between the Delay and Scale parameter values. In addition, it is advantageous to mix the filter characteristics so as to take into account even different filter parameters which are associated with one and the same speaker.

However, if the audio source is located at a position which does not lie on the connecting line 12 but, for example, underneath this connecting line 12, the speakers of the directional group RGC must also be active. For speakers located in the area VII, the three typically different parameter values for the same speaker parameter will then be taken into account, whereas for the area V and the area VI, the speaker parameters for the directional groups A and C and for one and the same speaker will be taken into account.

This scenario is once again summarized in FIG. 2*b*. No interpolation or mix of speaker parameters needs to be performed for the areas I, II, III in FIG. 1. Instead, one may simply take the parameter values associated with the speaker, since a speaker unambiguously associated has a single set of speaker parameters. However, an interpolation/mix of two different parameter values must be performed for the areas IV, V, and VI so as to have a new speaker parameter value for one and the same speaker.

For the area VII, consideration of two different speaker parameter values which are typically stored in a tabular form need not only follow in the calculation of the new speaker parameter, but there must be an interpolation of three values, i.e. a mixing of three values.

It shall be pointed out that overlaps of a higher order may also be admitted, namely that a speaker belongs to any number of directional groups.

In this case, what changes is only the requirement placed upon the mix/interpolation and the requirement placed upon the calculation of the weighting factors, which shall be set forth below.

Figure 9A:
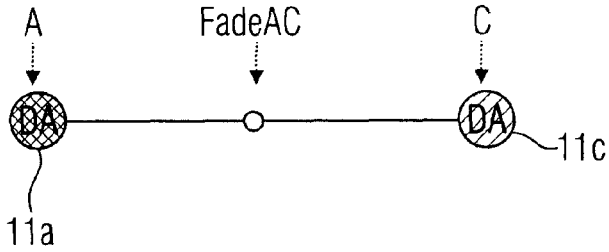
FIG. 9*a* shows a typical scenario of the movement of a source between a first directional group A and a second directional group C.

Reference shall now be made to FIG. 9*a*, FIG. 9*a* depicting the case where a source is moving from the directional zone A (11*a*) to the directional zone C (11*c*). The speaker signal LsA for a speaker in the directional zone A is reduced more and more as a function of the position of the source between A and B, i.e. of FadeAC in FIG. 9*a*, S1 linearly decreases from 1 to 0, whereas the speaker signal of the source C is attenuated more and more at the same time. This may be recognized in that $S_2$ linearly increase from 0 to 1. The fade-over factors $S_1$, $S_2$ are selected such that the sum of the two factors will result in 1 at any time. Alternative fade-overs, e.g. non-linear fade-overs, may also be employed. For all of these fade-overs it is advantageous that for each FadeAC value, the sum of the fade-over factors for the speakers concerned be equal to 1. Such non-linear functions are, for example for factor S1, a $COS^2$ function, whereas a $SIN^2$ function is employed for the weighting factor S2. Further functions are known in the art.

Figure 3A:
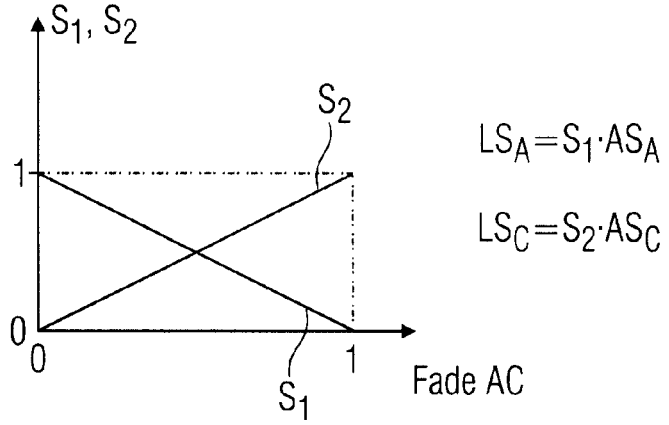
FIG. 3*a* shows a representation of a linear two-path fade-over.

It shall be noted that the representation in FIG. 3*a* provides a complete facing specification for all speakers in the areas I, II, III. It shall also be noted that the parameters of the table in FIG. 2*a* which have been associated with a speaker and come from the respective areas have already been taken into account in the calculation of the audio signal AS at the top right in FIG. 3*a*.

Figure 3B:
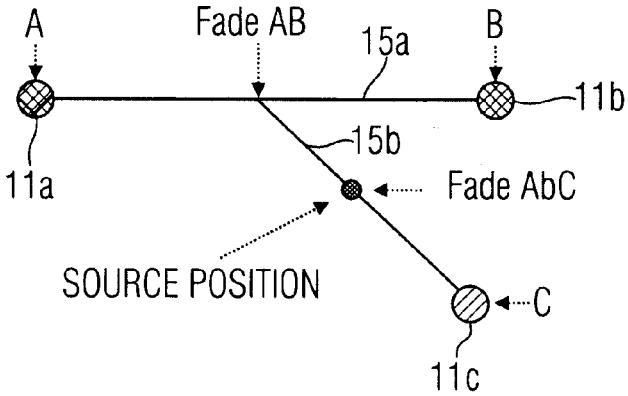
FIG. 3*b* shows a representation of a three-path fade-over.

In addition to the regular case defined in FIG. 9*a* where a source is located on a connecting line between two directional zones, the precise location between the start and the target directional zones being described by the fading factor AC, FIG. 3*b* depicts the case of compensation which will occur, for example, when the path of a source is changed as it is moving. Then the source is to be faded over from any current position located between two directional zones, this position being represented by FadeAB in FIG. 3*b*, to a new position. This results in the compensation path designated by 15*b* in FIG. 3*b*, whereas the (regular) path originally was programmed between the directional zones A and B and is designated as a source path 15*a*. Thus, FIG. 3*b* shows the case where there has been a change during a movement of the source from A to B, and therefore the original programming is changed to the effect that the source is now no longer to run to the directional zone B, but to the directional zone C.

The equations represented under FIG. 3*b* indicate the three weighting factors $g_1$, $g_2$, $g_3$ which provide the fading property for the speakers in the directional zones A, B, C. Again, it shall be noted that in the audio signal AS for the individual directional zones, the speaker parameters specific to the directional zones again have already been taken into account. For the areas I, II, III, the audio signals $AS_a$, $AS_b$, $AS_c$ from the original audio signal AS may be calculated simply by using the speaker parameters of column 16*a* in FIG. 2*a* which have been stored for the respective speakers, so as to then eventually perform the final fading weighting with the weighting factor $g_1$. Alternatively, however, these weightings need not be split up into different multiplications, but they will typically occur within one and the same multiplication, the scale factor Sk then being multiplied by the weighting factor $g^1$ so as to then obtain a multiplier which will eventually be multiplied by the audio signal to obtain the speaker signal $LS_a$. The same weighting $g_1$, $g_2$, $g_3$ is used for the overlap areas, an interpolation/mixing of the speaker parameter values specified for one and the same speaker needing to take place, however, for calculating the underlying audio signal $AS_a$, $AS_b$, or $AS_c$, as will be explained below.

It shall be noted that the three-path weighting factors $g_1$, $g_2$, $g_3$ will pass into the two-path fade-over of FIG. 3*a* if either FadeAbC is set to zero, in which case $g_1$, $g_2$ will remain, whereas in the other case, i.e. if FadeAB is set to zero, only $g_1$ and $g_3$ will remain.

Figure 4:
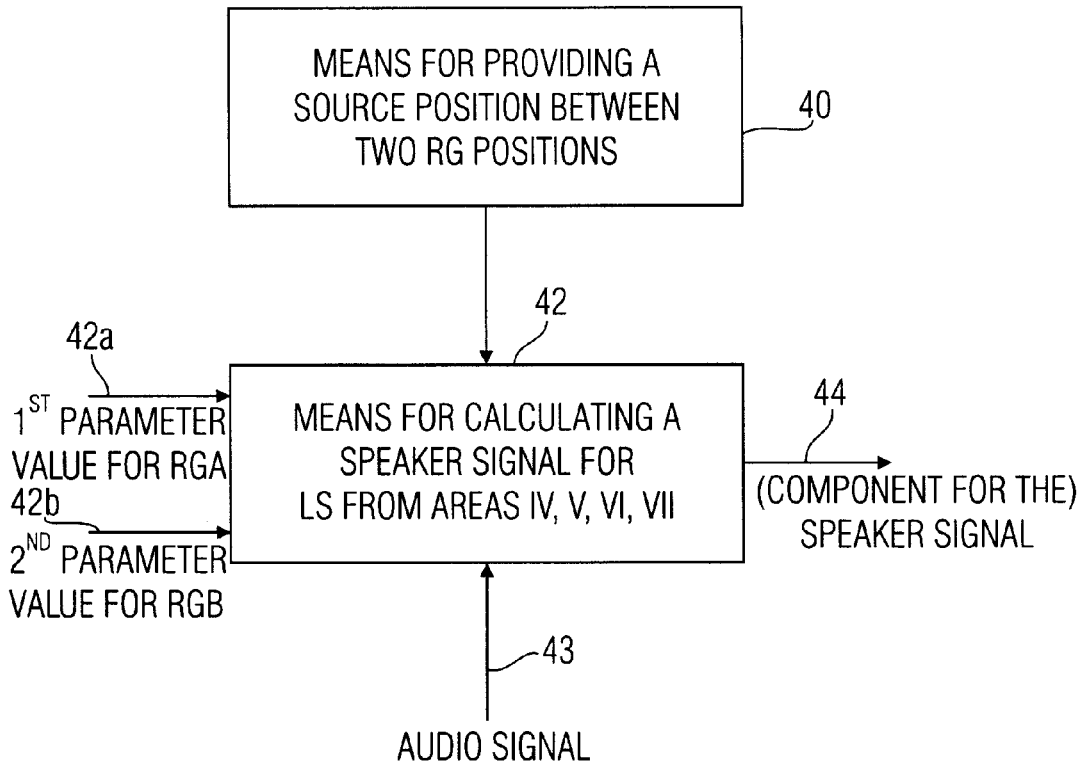
FIG. 4 shows a schematic block diagram of the apparatus for triggering a plurality of speakers using a DSP.

The apparatus for triggering will be explained below with reference to FIG. 4. FIG. 4 shows an apparatus for triggering a plurality of speakers, the speakers being grouped into directional groups, a first directional group having a first directional group position associated with it, a second directional group having a second directional group position associated with it, at least one speaker being associated with the first and second directional groups, and the speaker having a speaker parameter associated with it which for the first directional group has a first parameter value and which for the second directional group has a second parameter value. The apparatus initially includes the means 40 for providing a source position between two directional group positions, i.e. for example for providing a source position between the directional group position 11*a* and the directional group position 11*b*, as is specified, for example, by FadeAB in FIG. 3*b*.

The inventive apparatus further includes a means 42 for calculating a speaker signal for the at least one speaker on the basis of the first parameter value provided via the first parameter value input 42*a* which applies to the directional group RGA, and on the basis of a second parameter value provided to a second parameter value input 42*b* which applies to the directional group RGB. In addition, the means 42 for calculating obtains the audio signal via an audio signal input 43 so as to then provide, at the output side, the speaker signal for the contemplated speaker in the areas IV, V, VI, or VII. The output signal of the means 42 at the output 44 will be the actual audio signal if the speaker currently being contemplated is active only on account of a single audio source. However, if the speaker is active on account of several audio sources, a component will be calculated for each source by means of a processor 71, 72, or 73 for the speaker signal of the speaker contemplated on the basis of this one audio source 70*a*, 70*b*, 70*c* so as to eventually sum, in a summer 74, the N component signals designated in FIG. 7. Temporal synchronization here takes place via a control processor 75 which is advantageously also configured as a DSP (digital signal processor), just like the DSS processors 71, 72, 73.

Evidently, the present invention is not limited to the realization using application-specific hardware (DSP). Integrated implementation with one or several PCs or workstations is also possible and may even be advantageous for specific applications.

Figure 7:
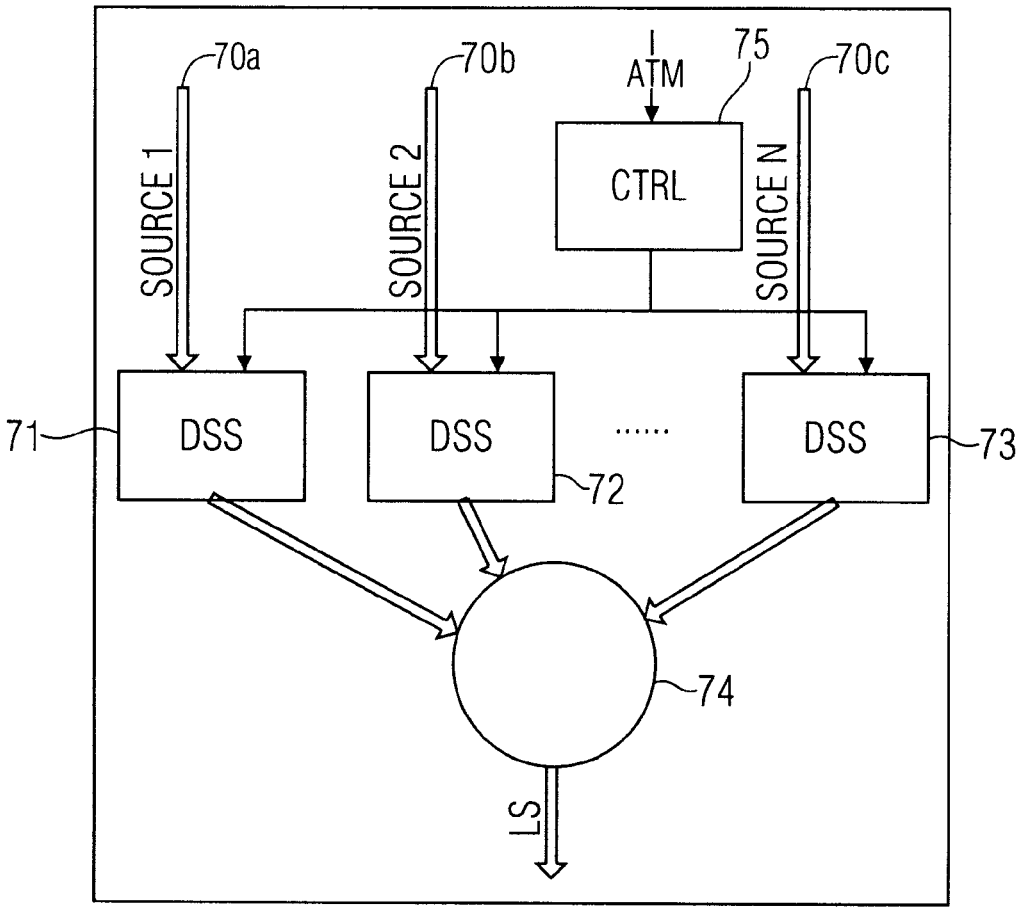
FIG. 7 is a schematic representation of the coming-about of a speaker signal from several individual speaker signals stemming from different audio sources.

It shall be noted that FIG. 7 depicts a sample-by-sample calculation. The summer 74 performs a sample-by-sample summation, whereas the delta stereophony processors 71, 72, 73 also output sample by sample, and the audio signal also advantageously being provided for the sources in a sample-by-sample manner. However, it shall be noted that when one proceeds to block-by-block processing, it will be possible to perform all processing operations in the frequency range as well, namely when spectra are summed up with one another within the summer 74. Of course, with each processing operation performed by means of a reciprocating transformation, a specific processing operation may be performed in the frequency range or in the time range, depending on which implementation is more suitable for the specific application. Similarly, a processing operation may also take place in the filterbank domain, in which case an analysis filterbank and a synthesis filterbank will then be necessitated for this purpose.

A detailed embodiment of the means 42 for calculating a speaker signal of FIG. 4 will be explained below with reference to FIG. 5.

The audio signal associated with an audio source is initially fed to a filter mixing block 44 via the audio signal input 43. The filter mixing block 44 is configured to take into account all of the three filter parameter settings EQ1, EQ2, EQ3 when a speaker in the area VII is taken into account. The output signal of the filter mixing block 44 then represents an audio signal which has been filtered in respective components, as will be described later on, to have influences, as it were, of the filter parameter settings of all three directional zones involved. This audio signal at the output of the filter mixing block 44 is then fed to a delay processing stage 45. The delay processing stage 45 is configured to generate a delayed audio signal, the delay of which now is based on an interpolated delay value, however, or, if interpolation is not possible, the waveform of which depends on the three delays D1, D2, D3. In the case of the delay interpolation, the three delays which are associated with a speaker for the three directional groups are made available to a delay interpolation block 46 to calculate an interpolated delay value $D_{int}$ which will then be fed into the delay processing block 45.

Finally, a scaling 46 is also performed, the scaling 46 being executed using an overall scaling factor which depends on the three scaling factors which are associated with one and the same speaker on account of the fact that the speaker belongs to several directional groups. This overall scaling factor is calculated in a scaling interpolation block 48. Advantageously, a weighting factor which describes the overall fading for the directional zone and has been set forth in the context of FIG. 3*b* is also fed to the scaling interpolation block 48, as is represented by an input 49, so that by means of the scaling, in block 47 the final speaker signal component is output on the basis of a source for a speaker, which, in the embodiment shown in FIG. 5, may belong to three different directional groups.

All of the speakers of the other directional groups, except for the three directional groups in question by means of which a source is defined, output no signals for this source, but may evidently be active for other sources.

Figure 5:
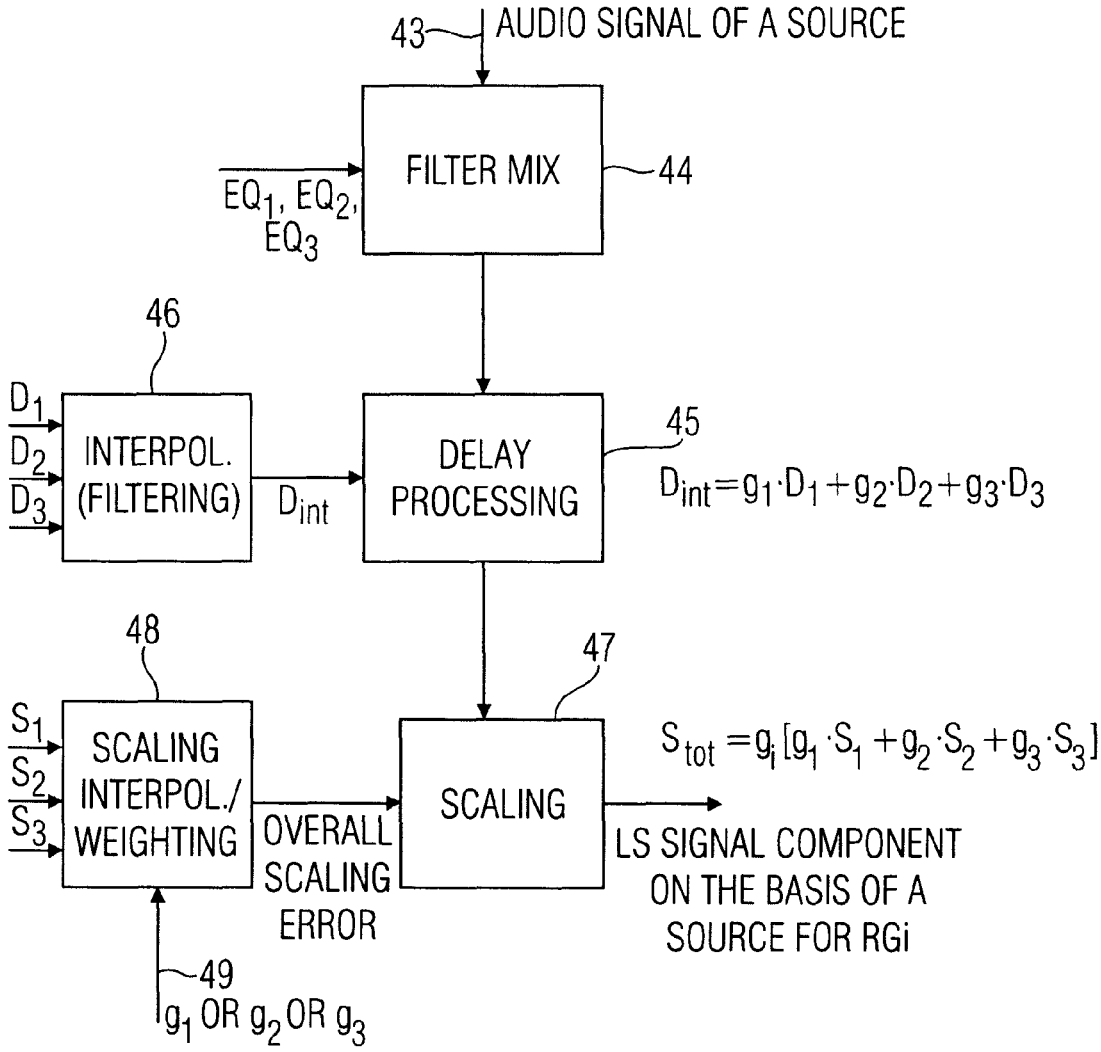
FIG. 5 shows a more detailed representation of the means for calculating a speaker signal of FIG. 4 in accordance with an advantageous embodiment.

It shall be noted that the same weighting factors as are used for fading may be used for interpolating the delay $D_{int}$ or for interpolating the scaling factor S, as is set forth by the equations in FIG. 5 next to the blocks 45 and 47, respectively.

Figure 6:
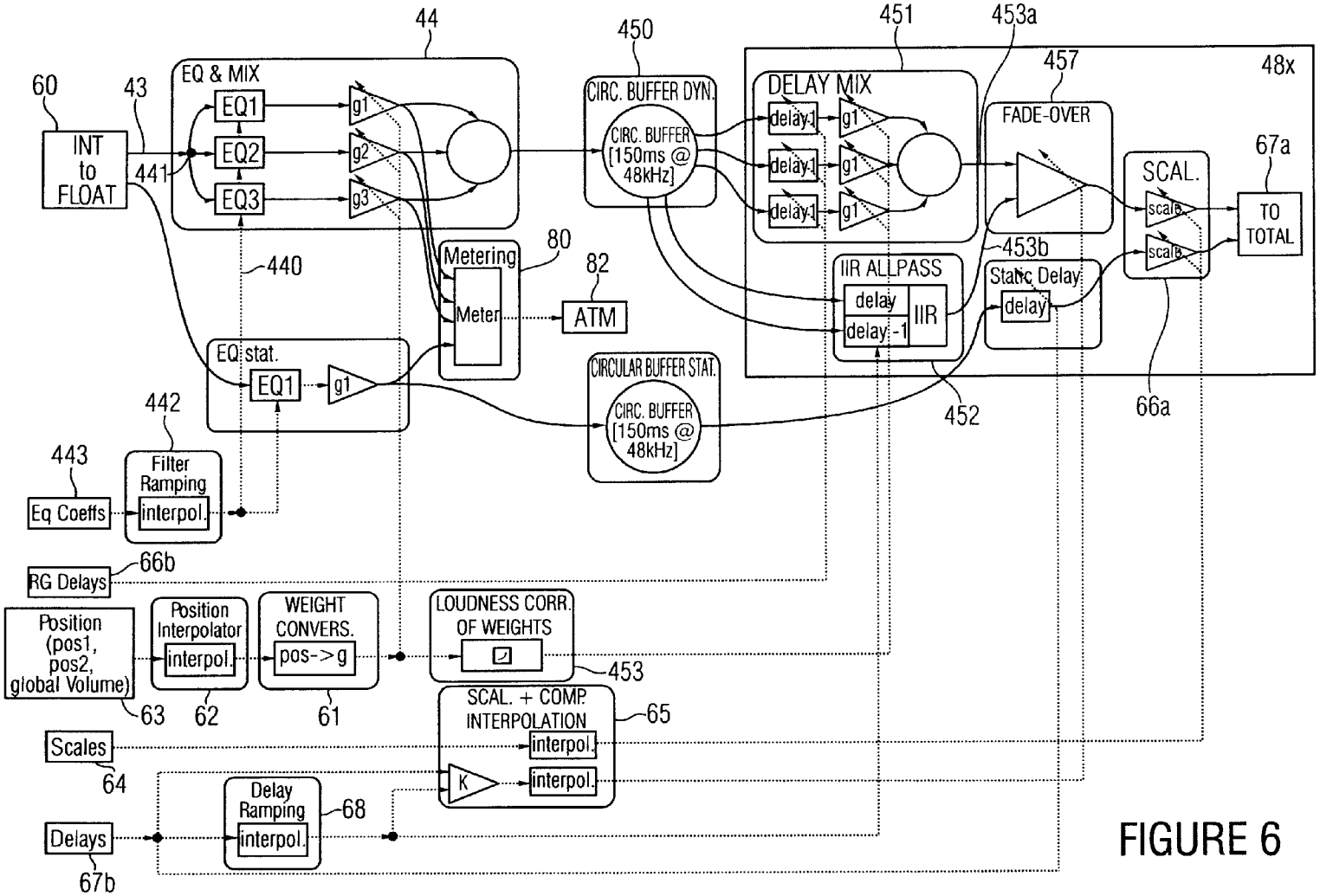
FIG. 6 shows an advantageous implementation of a DSP for implementing delta stereophony.

An advantageous embodiment of the present invention which is implemented on a DSP will be presented below with reference to FIG. 6. The audio signal is provided via an audio signal input 43, an integer/floating-point transformation being initially performed in a block 60 if the audio signal is present in an integer format. FIG. 6 shows an advantageous embodiment of the filter mixing block 44 in FIG. 5. In particular, FIG. 6 includes filters EQ1, EQ2, EQ3, the transfer functions or pulse responses of the filters EQ1, EQ2, EQ3 being controlled by respective filter coefficients via a filter coefficient input 440. The filters EQ1, EQ2, EQ3 may be digital filters which perform a convolution of an audio signal with the pulse response of the respective filter, or there may be transformation means, a weighting of spectral coefficients being performed by means of frequency transfer functions. The signals filtered with the equalizer settings in EQ1, EQ2, EQ3, which all go back to one and the same audio signal, as is shown by a point of distribution 441, are then weighted, in respective scaling blocks, with the weighting factors $g_1$, $g_2$, $g_3$ so as to then sum up the results of the weightings within a summer. Feeding is then performed into a circular buffer, which is part of the delay processing 45 of FIG. 5, at the output of block 44, i.e. at the output of the summer. In an advantageous embodiment of the present invention, the equalizer parameters EQ1, EQ2, EQ3 are not taken directly, as they are given in the table represented in FIG. 2*a*, but advantageously, the equalizer parameters are interpolated, which is performed in a block 442.

However, on the input side, block 442 actually obtains the equalizer coefficients associated with a speaker, as is represented by a block 443 in FIG. 6. The interpolation task of the filter ramping block performs low-pass filtering of successive equalizer coefficients, as it were, to avoid artefacts due to rapidly changing equalizer filter parameters EQ1, EQ2, EQ3.

Thus, the sources may be faded over across several directional zones, these directional zones being characterized by different settings for the equalizers. Fade-overs are performed between the different equalizer settings, all equalizers being passed through in parallel, and the outputs being faded over, as is shown in block 44 in FIG. 6.

It shall also be noted that the weighting factors $g_1$, $g_2$, $g_3$ as are used in block 44 for fading over, or mixing, the equalizer settings, are the weighting factors represented in FIG. 3*b*. For calculating the weighting factors, there is a weighting factor conversion block 61 which converts a position of a source to weighting factors for advantageously three surrounding directional zones. Block 61 has a position interpolator 62 connected upstream from it which typically calculates a current position as a function of an input of a starting position (POS1) and a target position (POS2) and of the respective fading factors which are the factors fade AB and fade ABC in the scenario shown in FIG. 3*b*, and typically as a function of a speed-of-movement input made at a current point in time. The positional input takes place in a block 63. However, it shall be noted that a new position may be input at any time, so that the position interpolator need not be provided. In addition, it shall be noted that the position updating rate may be adjusted as desired. For example, a new weighting factor might be calculated for each sample. However, this is not advantageous. Rather, one has found that the weighting factor update rate must occur only with a fraction of the sampling frequency also with regard to useful avoidance of artefacts.

The scaling calculation represented using blocks 47 and 48 in FIG. 5 is shown only in part in FIG. 6. Calculation of the overall scaling factor, which has been conducted in block 48 of FIG. 5, does not take place in the DSP represented in FIG. 6, but in an upstream control DSP. As is shown by "scales" 64, the overall scaling factor is already input and is interpolated in a scaling/interpolation block 65 so as to eventually perform a final scaling in a block 66*a* prior to then proceeding to the summer 74 of FIG. 7, as is shown in a block 67*a*.

With reference to FIG. 6, the advantageous embodiment of the delay processing 45 of FIG. 5 will be represented below.

The inventive apparatus enables two delay processing operations. One delay processing operation is the delay mixing operation 451, whereas the other delay processing operation is the delay interpolation which is performed by an IIR all-pass 452.

The output signal of the block 44 which has been stored in the circular buffer 450 is provided, in the delay mixing operation illustrated below, including three different delays, the delays, with which the delay blocks in block 451 are triggered, being the non-smoothened delays indicated in the table which has been discussed for a speaker with reference to FIG. 2*a*. This fact is also elucidated by a block 66*b* which indicates that the directional group delays are input here, while the directional group delays are not input in a block 67*b*, but only one delay for one speaker at a time, namely the interpolated delay value $D_{int}$, which is generated by block 46 in FIG. 5.

The audio signal in block 451, which is present with three different delays, is then weighted with a weighting factor in each case, as is shown in FIG. 6, weighting factors, however, now advantageously not being the weighting factors generated by linear fade-over, as is shown in FIG. 3*b*. Rather, it is advantageous to perform a loudness correction of the weights in a block 453 so as to achieve non-linear three-dimensional fade-over here. One has found that the audio quality in the case of delay mixing will then be higher and more free from artefacts, even though the weighting factors $g_1$, $g_2$, $g_3$ could also be used to trigger the scalers in the delay mixing block 451. The output signals of the scalers in the delay mixing block are then summed to obtain a delay mixing audio signal at an output 453.

Alternatively, the inventive delay processing (block in FIG. 5) may also perform a delay interpolation. To this end, in an advantageous embodiment of the present invention, an audio signal comprising the (interpolated) delay, which is provided via block 67*b* and which has additionally been smoothened in a delay ramping block 68, is read out from the circular buffer 450. In addition, in the embodiment shown in FIG. 6, the same audio signal, which, however, is delayed by one sample, is also read out. These two audio signals, or samples, which have just been contemplated, of the audio signals, are then fed to an IIR filter for interpolation so as to obtain, at an output 453*b*, an audio signal which has been generated on the basis of an interpolation.

As has already been explained, the audio signal at the input 453*a* hardly comprises any filter artefacts because of the delay mix. By contrast, the audio signal at the output 453*b* is hardly free from filter artefacts. However, this audio signal may have shifts in the level of frequency. If the delay is interpolated from a long delay value to a short delay value, the frequency shift will be a shift toward higher frequencies, whereas the frequency shift will be a shift toward lower frequencies if the delay is interpolated from a short delay to a long delay.

In accordance with the invention, switchover is performed between the output 453*a* and the output 453*b* in the fade-over block 457 which is controlled by a control signal which comes from block 65 and the calculation of which will be dealt with later on.

In addition, one controls, in block 65, whether block 457 passes on the result of the mixing or the interpolation, or the ratio in which the results are mixed. To this end, the smoothened or filtered value from block 68 is compared to the non-smoothened value so as to perform the (weighted) switchover in 457, depending on which of them is larger.

The block diagram in FIG. 6 further comprises a branch for a static source which is located in a directional zone and need not be faded over. The delay for this source is the delay associated with the speaker for this directional group.

Therefore, the delay calculating algorithm switches in the event of movements which are too slow or too fast. The same physical speaker exists in two directional zones with different level and delay settings. In the event of a slow movement of the source between the two directional zones, the level is faded and the delay is interpolated by means of an all-pass filter, that is the signal at the output 453*b* is taken. However, this interpolation of the delay leads to a change of pitch of the signal, which, however, is not critical in the event of slow changes. By contrast, if the speed of the interpolation exceeds a specific value, such as 10 ms per second, these changes in pitch may be perceived. In the event of too high a speed, the delay will therefore no longer be interpolated, but the signals comprising the two constant different delays are faded, as is depicted in block 451. Admittedly, this results in comb filter artefacts. However, these will not be audible due to the high fading speed.

As has been explained, switchover between the two outputs 453*a* and 453*b* takes place as a function of the movement of the source, or more specifically, as a function of the delay value to the interpolated. If a large amount of delay must be interpolated, the output 453*a* will be switched through block 457. If, on the other hand, a small amount of delay must be interpolated within a specific period of time, the output 453*b* will be taken.

However, in an advantageous embodiment of the present invention, switchover through block 457 is not performed in a hard manner. Block 475 is configured such that there is a fade-over range arranged around the threshold value. If, therefore, the speed of the interpolation is at the threshold value, block 457 is configured to calculate the output-side sample in such a manner that the current sample on the output 453*a* and the current sample on the output 453*b* are added, and the result is divided by two. Therefore, in a fade-over range around the threshold value, block 457 performs a soft transition from the output 453*b* to the output 453*a*, or vice versa. This fade-over range may be configured to have any size, such that block 457 works almost continuously in the fade-over mode. For a switchover which tends to be harder, the fade-over range may be selected to be smaller, so that block 457 most of the time switches only the output 453*a* or only the output 453*b* through to the scaler 66*a*.

In an advantageous embodiment of the present invention, the fade-over block 457 is further configured to perform a jitter suppression via a low-pass and a hysteresis of the delay change threshold value. Because of the non-guaranteed runtime of the control data flux between the system for configuration and the DSP systems, there may be jitter in the control files which may lead to artefacts in audio signal processing. It is therefore advantageous to compensate for this jitter by low-pass filtering the control data stream at the input of the DSP system. This method reduces the reaction time of the control times. On the other hand, very large jitter variations may be compensated for. However, if different threshold values are used for the switchover from delay interpolations to a delay fade-over, and from a delay fade-over to delay interpolation, the jitter in the control data may be avoided, as an alternative to low-pass filtering, without reducing the control-data reaction time.

In a further advantageous embodiment of the present invention, the fade-over block 457 is further configured to perform control data manipulation when fading from delay interpolations to delay fading.

If the delay change rises sharply to a value larger than the switchover threshold value between delay interpolations and delay fade-over, part of the pitch variation from the delay interpolation will still be audible in conventional fading. To avoid this effect, the fade-over block 457 is configured to keep the delay control data constant for such time until the complete fade-over to the delay fading has been accomplished. It is only then that the delay control data is matched to the actual value. Using this control data manipulation, it is possible to realize even fast delay changes with a short control data reaction time without any audible tone changes.

In the advantageous embodiment of the present invention, the triggering system further comprises a metering means 80 configured to perform digital (imaginary) metering per directional zone/audio output. This is explained with reference to FIGS. 11*a* and 11*b*. For example, FIG. 11*a* shows an audio matrix 1110, whereas FIG. 11*b* shows the same audio matrix 1110, but while taking into account the static sources, while in FIG. 11*a*, the audio matrix is represented while taking into account the dynamic sources.

Figure 11A:
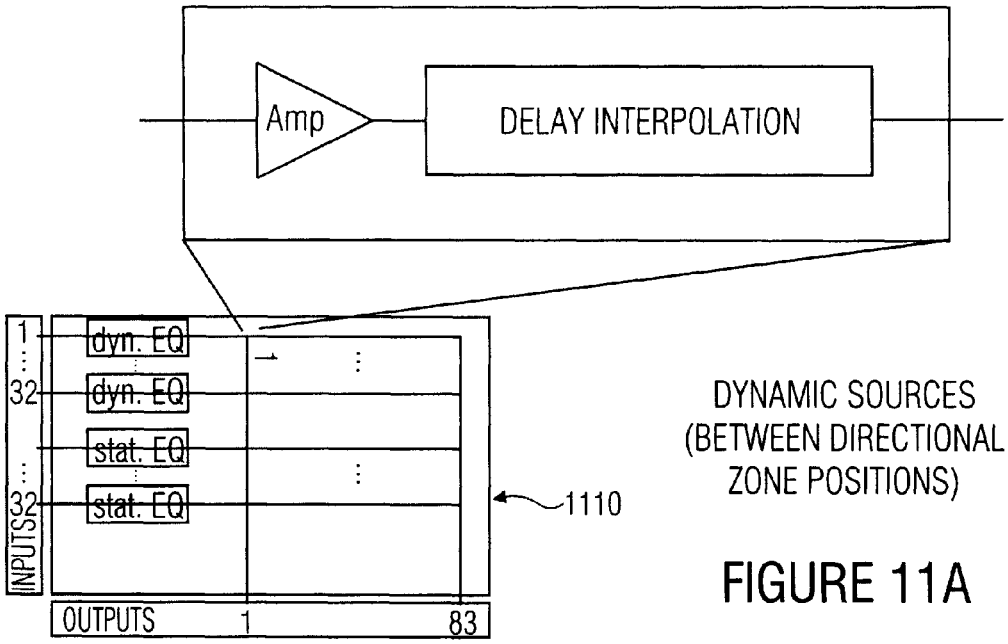
FIG. 11*a* is a representation of an input/output matrix for dynamic sources.
Figure 11B:
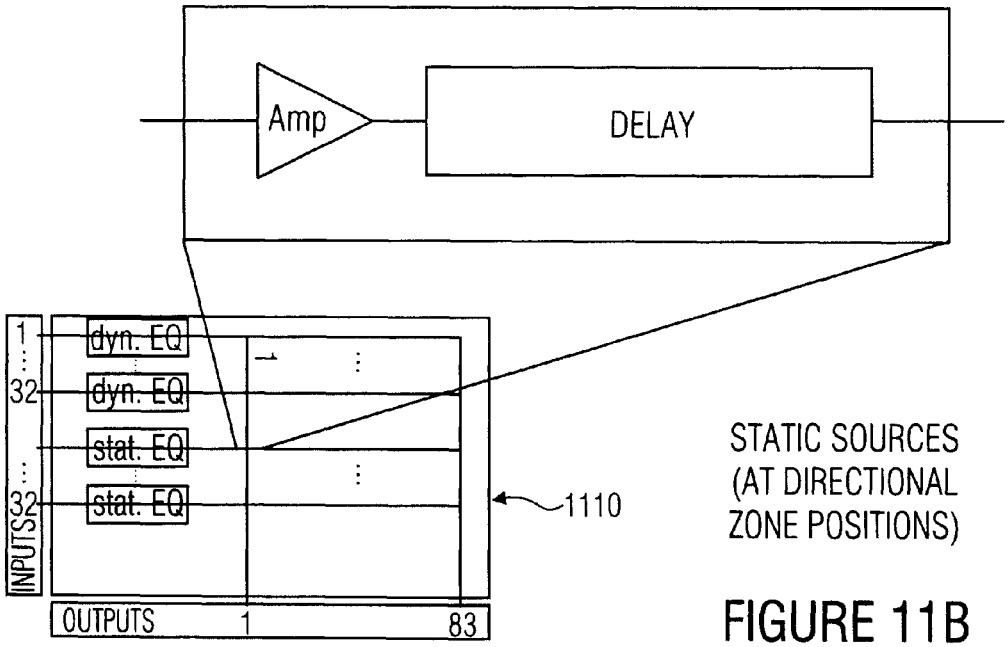
FIG. 11*b* is a representation of an input/output matrix for static sources.

Generally, the DSP system, part of which is shown in FIG. 6, results in that a delay and a level are calculated from the audio matrix at each matrix point, the level scaling value being represented by AmP in FIG. 11*a* and FIG. 11*b*, while the delay is designated by "delay interpolation" for dynamic sources and "delay" for static sources, respectively.

In order to present these settings to the user, these settings are stored in such a manner that they are split up into directional zones, and then the directional zones have input signals allocated to them. In this context, several input signals may also be allocated to one directional zone.

So as to facilitate monitoring of the signals on the user side, metering for the directional zones is indicated by block 80, which, however, is determined "virtually" from the levels of the node points of the matrix and the respective weightings.

The results are supplied to a display interface by the metering block 80, which is symbolically illustrated by a block "ATM" 82 (ATM=asynchronous transfer mode).

It is to be noted here that, typically, several sources are simultaneously playing in directional zones, for example when considering the case where two separate sources "enter" into one and the same directional zone from two different directions. In the auditorium, it will never be possible to measure the contribution of one single source per directional zone. This is achieved, however, by the metering 80, which is why this measurement is referred to as a virtual measurement, since, in a sense, all contributions of all directional groups for all sources will superimpose in the auditorium.

Moreover, the metering 80 may also serve to calculate the overall level of one single sound source among several sound sources across all directional zones active for this sound source. This result would arise if the matrix points for all outputs were summed up for one input source. By contrast, a contribution of a directional group for a sound source may be achieved by summing up the outputs of the total number of outputs belonging to the directional group contemplated, whereas the other outputs are not taken into account.

In general, the inventive concept provides a universal operating concept for the representation of sources independently of the reproduction system used. Here, a hierarchy is fallen back on. The bottommost hierarchy member is the individual speaker. The middle hierarchy stage is a directional zone, it also being possible for speakers to be present in two different directional zones.

The topmost hierarchy member is directional-zone presets, such that for specific audio objects/applications, specific directional zones taken together may be considered as an "umbrella directional zone" on the user interface.

The inventive system for positioning sound sources is divided into main components including a system for conducting a performance, a system for configuring a performance, a DSP system for calculating the delta stereophony, a DSP system for calculating the wave-field synthesis, and a breakdown system for emergency interventions. In an advantageous embodiment of the present invention, a graphical user interface is used to achieve visual allocation of the protagonists to the stage or camera image. To the system operator, a two-dimensional mapping of the 3D space is presented, which may be configured such as shown in FIG. 1, which may, however, also be implemented in a manner as illustrated in FIGS. 9*a* to 10*b* for only a small number of directional groups. By means of a suitable user interface, the user allocates directional zones and speakers from the three-dimensional space to the two-dimensional mapping via selected symbolism. This is effected by means of a configuration setting. For the system, mapping of the two-dimensional position of the directional zones on the screen to the real three-dimensional position of the speakers allocated to the respective directional zone is effected. With the help of his/her context with regard to the three-dimensional space, the operator is capable of reconstructing the real three-dimensional position of directional zones and realizing an arrangement of sounds in the three-dimensional space.

Via a further user interface (mixer) and the association of the sounds/protagonists and their movements with the directional zones taking place there, if being possible for the mixer to comprise a DSP according to FIG. 6, the indirect positioning of the sound sources in the real three-dimensional space is effected. By means of this user interface, the user is capable of positioning the sounds in all spatial dimensions without having to change the perspective, i.e. it is possible to position sounds in height and depth. In the following, the positioning of sound sources and a concept for the flexible compensation of deviations from the programmed stage activity in accordance with FIG. 8 will be illustrated.

Figure 8:
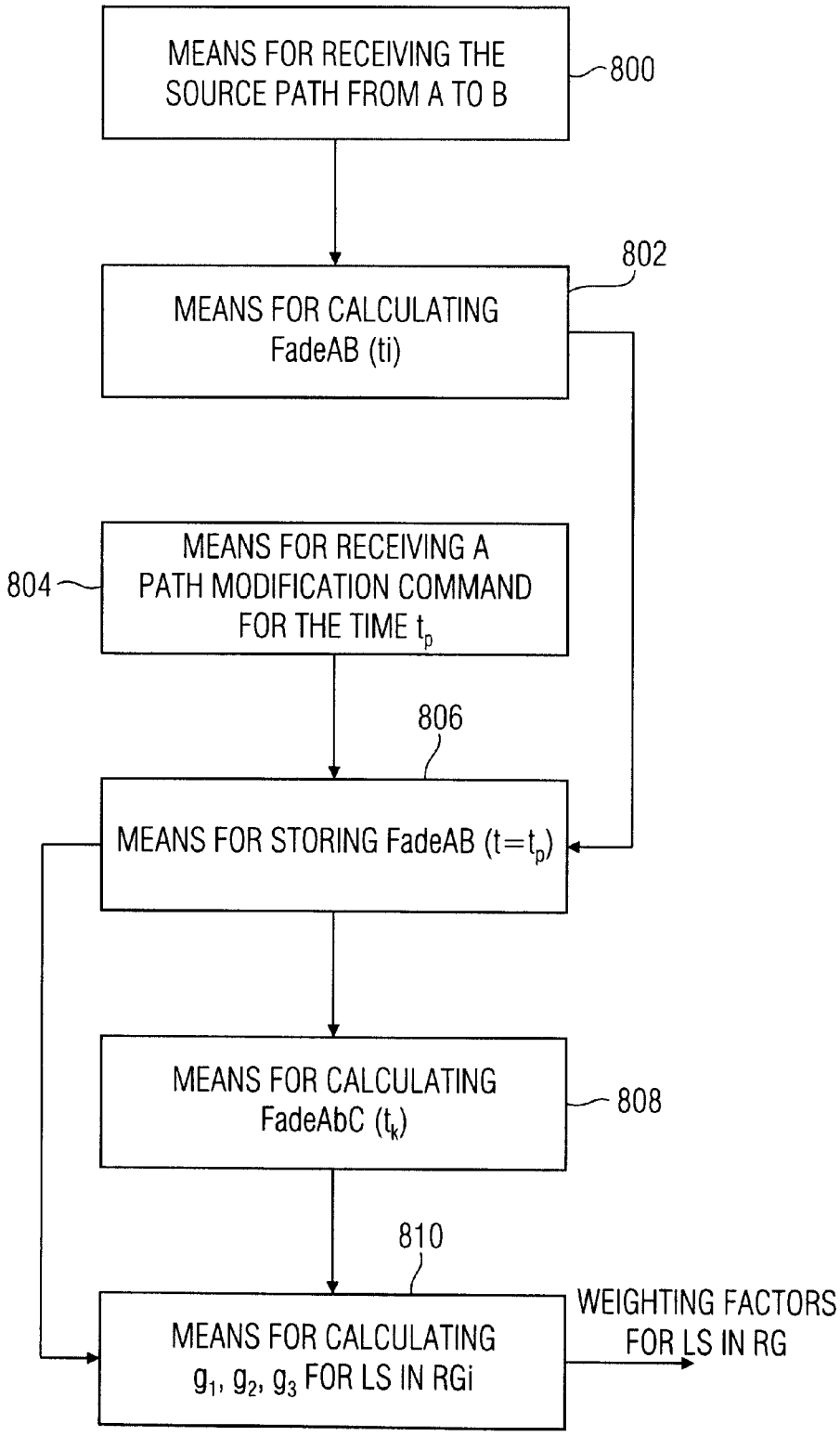
FIG. 8 is a schematic representation of an apparatus for controlling a plurality of speakers which may be based on a graphical user interface.

FIG. 8 shows an apparatus for controlling a plurality of speakers, advantageously using a graphical user interface, which are grouped into at least three directional groups, each directional group having a directional group position associated with it. The apparatus initially comprises means 800 for receiving a source path from a first directional group position to a second directional group position, and movement information for the source path. The apparatus of FIG. 8 further comprises means 802 for calculating a source path parameter for different points in time, based on the movement information, the source path parameter indicating a position of an audio source on the source path.

The inventive apparatus further comprises means 804 for receiving a path modification command so as to define a compensation path to the third directional zone. Furthermore, means 806 for storing a value of the source path parameter is provided at a position at which the compensation path branches off from the source path. Advantageously, means for calculating a compensation path parameter (FadeAC) is also present which indicates a position of the audio source on the compensation path as denoted by 808 in FIG. 8. Both the source path parameter, which has been calculated by the means 806, and the compensation path parameter, which has been calculated by the means 808, are fed to means 810 for calculating weighting factors for the speakers of the three directional zones.

In general terms, the means 810 for calculating the weighting factors is configured to operate in a manner based on the source path, the stored value of the source path parameter and information on the compensation path, information on the compensation path including either the new destination only, i.e. the directional zone C, or the information on the compensation path additionally including a position of the source on the compensation path, i.e. the compensation path parameter. It is to be noted that this information of the position on the compensation path will not be necessary if the compensation path has not yet been entered or if the source is still on the source path. Thus, the compensation path parameter indicating a position of the source on the compensation path is not indispensable, namely when the source does not enter the compensation path but uses the compensation path as an opportunity to reverse back to the starting point on the source path so as to, in a sense, move directly from the starting point to the new destination without a compensation path. This possibility is useful when the source finds that it has covered only a short distance on the source path, and the advantage of henceforth taking a new compensation path is only minor. Alternative implementations, wherein a compensation path is used as an opportunity to return and move back on the source path without entering the compensation path, may exist when the compensation path would involve areas in the auditorium, which, for any other reasons, are not to be any areas in which a sound source is to be localized.

The inventive provision of a compensation path is particularly advantageous with regard to a system that only allows complete paths between two directional zones to be entered, since the time when a source is at a new (modified) position is substantially reduced, particularly when directional zones are spaced far apart. Furthermore, artificial paths of a source or paths which are confusing to the user and are perceived as strange are eliminated. If, for example, the case is considered where a source is originally supposed to move from left to right on the source path and now is to move to a different position at the very left which is not very far from the original position, not admitting a compensation path would result in the source running across the entire stage almost twice, while the invention shortens this process.

The compensation path is facilitated by the fact that a position is no longer determined by two directional zones and one factor, but that a position is defined by three directional zones and two factors, such that other points apart from the direct connecting lines between two directional group positions may also be "triggered" by a source.

Therefore, the inventive concept allows any point in a reproduction space to be triggered by a source, as can be directly seen from FIG. 3*b*.

FIG. 9*a* shows a regular case in which a source is located on a connecting line between the start directional zone 11*a* and the destination directional zone 11*c*. The exact position of the source between the start and the destination directional zones is described by a fading factor AC.

However, as has already been set forth and discussed in the context of FIG. 3*b*, in addition to the regular case there is the compensation case, which occurs when the path of a source is changed during movement. The modification of the path of the source during movement may be represented by the destination of the source changing while the source is on its way to the destination. In this case, the source must be faded from its current source position on the source path 15*a* in FIG. 3*b* to its new position, i.e. the destination 11*c*. This results in the compensation path 15*b*, on which the source will move until it has reached the new destination 11*c*. The compensation path 15*b* also extends from the original position of the source directly to the new ideal position of the source. In the compensation case, the source position is therefore configured across three directional zones and two fading values. The directional zone A, the directional zone B and the fading factor FadeAB form the beginning of the compensation path. The directional zone C forms the end of the compensation path. The fading factor FadeAbC defines the position of the source between the beginning and the end of the compensation path.

At the transition of a source into the compensation path, the following modifications will occur at the positions: the directional zone A is maintained. The directional zone C turns into the directional zone B, and the fading factor FadeAC turns into FadeAB and the new destination directional zone is written to the destination directional zone C. In other words, the fading factor FadeAC is stored by the means 806, and is used for the subsequent calculation of FadeAB, at the time when the direction modification is to take place, i.e. at the time when the source is to leave the source path and to enter the compensation path. The new destination directional zone is written to the directional zone C.

According to the invention, it is further advantageous to prevent hard source jumps. In general, source movements may be programmed such that sources are able to jump, i.e. to move rapidly from one position to another. This is the case, for example, when scenes are skipped, when a channelHOLD mode is deactivated or when a source ends on another directional zone in scene 1 than in scene 2. If all source jumps were switched hard, this would result in audible artefacts. Therefore, a concept for preventing hard source jumps is employed in accordance with the invention. For this purpose, again a compensation path is used, which is selected based on a specific compensation strategy. In general, a source may be located at different positions of a path. Depending on whether it is located at the beginning or at the end, between two or three directional zones, there will be different ways in which the source moves fastest to its desired position.

Figure 9B:
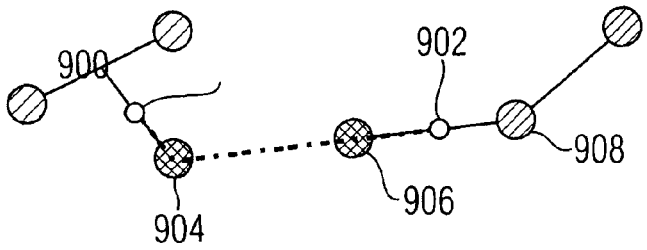
FIG. 9*b* is a schematic representation of the movement in accordance with a compensation strategy to avoid a hard jump of a source.

FIG. 9*b* shows a possible compensation strategy according to which a source located at a point of a compensation path (900) is to be moved to a destination position (902). The position 900 is the position the source may have when a scene ends. At the beginning of the new scene, the source is to be moved to its initial position there, i.e. the position 906. In order to arrive there, an immediate switchover from 900 to 906 is dispensed with in accordance with the invention. Instead, the source initially moves toward its personal destination directional zone, i.e. to the directional zone 904, so as to then move from there to the initial directional zone of the new scene, i.e. 906. As a consequence, the source is at the point where it should have been at the beginning of the scene. However, since the scene has already begun and the source actually would already have started moving, the source to be compensated must move on the programmed path between the directional zone 906 and the directional zone 908 at an increased speed until it has caught up with its target position 902.

Figure 9C:
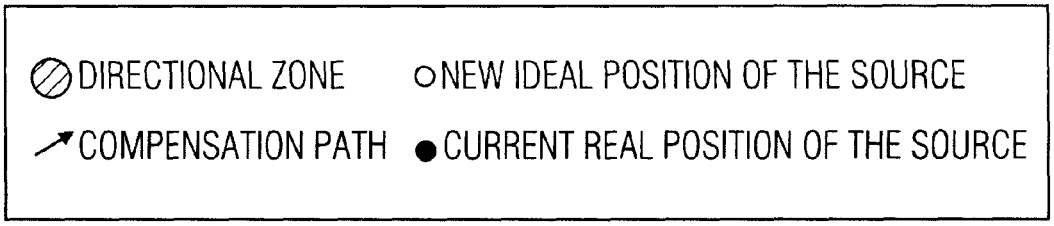
FIG. 9*c* is a legend for FIGS. 9*d* to 9*i;*

In general, an illustration of different compensation strategies all obeying the notation for the directional zone, the compensation path, the new ideal position of the source and the current real position of the source given in FIG. 9*c* will be given below in FIGS. 9*d* to 9*i*.

Figure 9D:
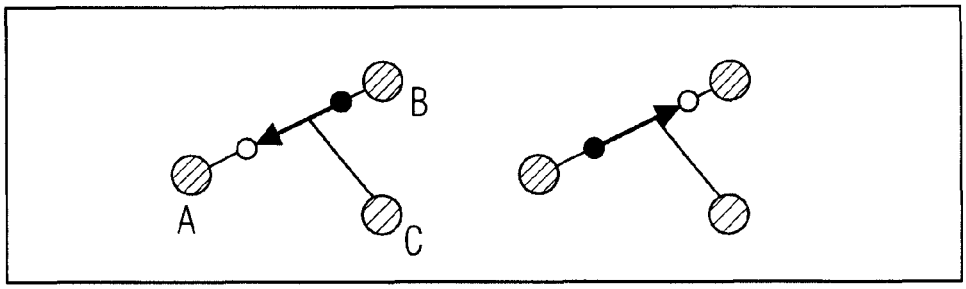
FIG. 9*d* is a representation of the "InpathDual" compensation strategy.
Figure 9E:
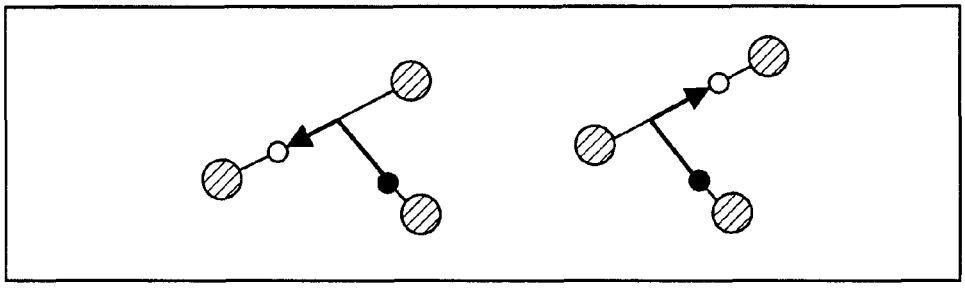
FIG. 9*e* is a schematic representation of the "InpathTriple" compensation strategy.

A simple compensation strategy can be seen in FIG. 9*d*. It is denoted with "InPathDual". The destination position of the source is designated by the same directional zones A, B, C as the starting position of the source. Inventive jump compensation means is therefore configured to ascertain that the directional zones for the definition of the starting position are identical to the directional zones for the definition of the destination position. In this case, the strategy shown in FIG. 9*d* is chosen in which simply the same source path is followed. If, then, the position to be reached by the compensation (ideal position) is located between the same directional zones as the current position of the source (real position), the InPath strategies will be employed. They come in two kinds, i.e. InPathDual, as shown in FIG. 9*d*, and InPathTriple, as shown in FIG. 9*e*. FIG. 9*e* further shows the case where the real and ideal positions of the source are located not between two, but between three directional zones. In this case, the compensation strategy shown in FIG. 9*e* will be used. In particular, FIG. 9*e* shows the case where the source is already on a compensation path and is returning on this compensation path so as to reach a specific point on the source path.

Figure 9F:
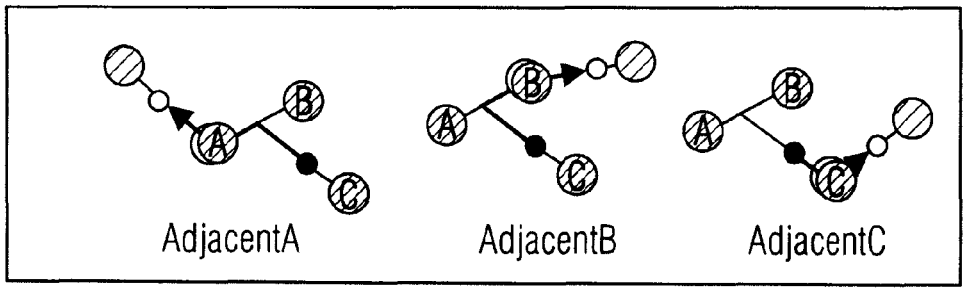
FIG. 9*f* is a schematic representation of the AdjacentA, AdjacentB, AdjacentC compensation strategies.

As has been set forth, the position of a source is defined across a maximum of three directional zones. If the ideal position and the real position have exactly one common directional zone, the Adjacent strategies shown in FIG. 9*f* will be employed. There are three kinds, the letters "A", "B" and "C" referring to the common directional zone. The current compensation means in particular determines that the real position and the new ideal position are defined by sets of directional zones having one single directional zone in common, which in the case of AdjacentA is the directional zone A, which in the case of AdjacentB is the directional zone B and which in the case of AdjacentC is the directional zone C, as can be seen in FIG. 9*f*.

Figure 9G:
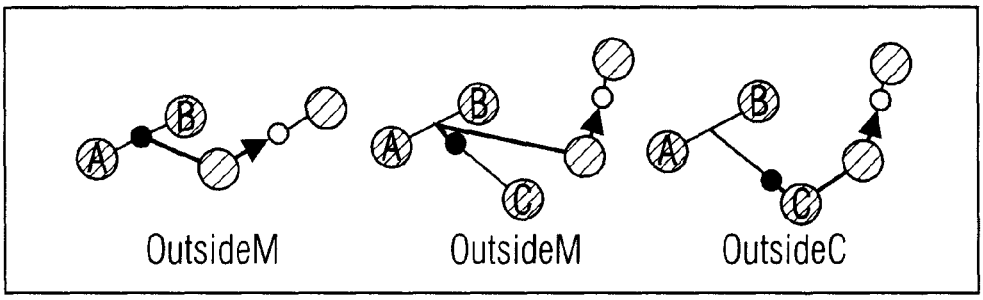
FIG. 9*g* is a schematic representation of the OutsideM and OutsideC compensation strategies.
Figure 9H:
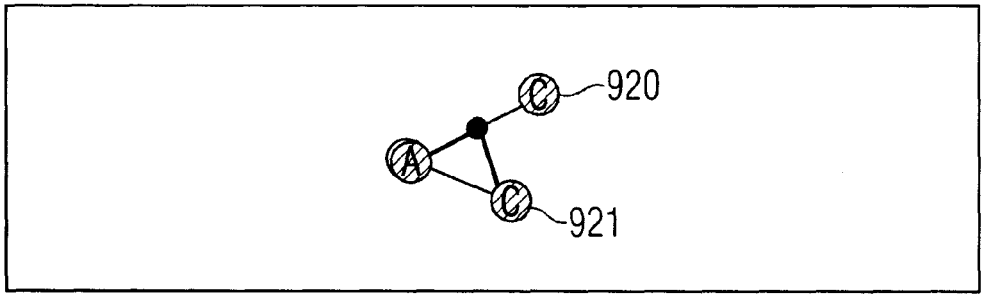
FIG. 9*h* is a schematic representation of a Cader compensation path.

The Outside strategies shown in FIG. 9*g* will be used if the real position and the ideal position do no have a common directional zone in common. Here, there are two kinds, i.e. the OutsideM strategies and the OutsideC strategies. OutsideC will be employed if the real position is very close to the position of the directional zone C. OutsideM will be employed if the real position of the source is located between two direction positions or if the position of the source is indeed located between three directional zones but is very close to the knee.

It is further to be noted that in the advantageous implementation of the present invention any directional zone may be connected to any directional zone, so that the source, in order to from one directional zone to another directional zone, never has to cross a third directional zone, but that there will be a programmable source path from any directional zone to any other directional zone.

In an advantageous embodiment of the present invention, the source is moved manually, i.e. by means of a so-called Cader. There are inventive Cader strategies which provide different compensation paths. It is desired that the Cader strategies usually result in a compensation path connecting the directional zone A and the directional zone C of the ideal position to the current position of the source. Such a compensation path can be seen in FIG. 9*h*. The newly attained real position is the directional zone C of the ideal position, the compensation path arising, in FIG. 9*h*, when the directional zone C of the real position is modified from the directional zone 920 to the directional zone 921.

Figure 9I:
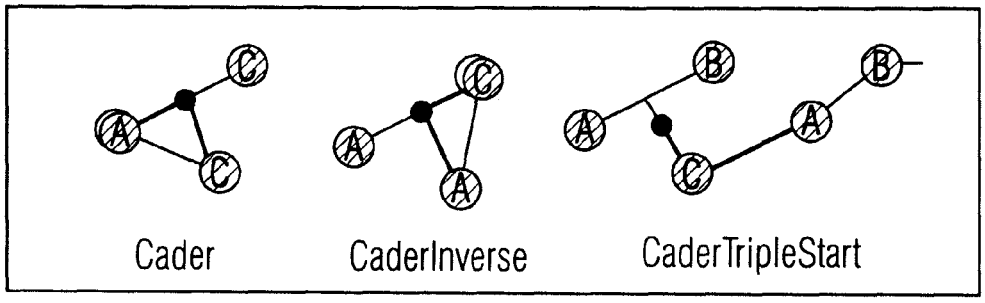
FIG. 9*i* is a schematic representation of three Cader compensation strategies.

Altogether, there are three Cader strategies that are shown in FIG. 9*i*. The left-hand strategy in FIG. 9*i* is employed when the destination directional zone C of the real position was changed. As far as the course of the path is concerned, Cader corresponds to the OutsideM strategy. Caderinverse is employed when the start directional zone A of the real position is changed. The compensation path arising behaves in a similar manner to the compensation path in the normal case (Cader), it being possible, however, for the calculation to differ within the DSP. CaderTriplestart is employed when the real position of the source is located between three direction positions and a new scene is on. In this case, a compensation path from the real position of the source to the start directional zone of the new scene must be built.

The Cader may be used for performing an animation of a source. With regard to the calculation of the weighting factors, there is no difference which depends on whether the source is moved manually or automatically. A fundamental difference, however, is the fact that the movement of the source is not controlled by a timer but is triggered by a Cader event that the means (804) for receiving a path modification command is receiving. The Cader event is therefore the path modification command. A special case that the inventive source animation supplies by means of Cader is the backward movement of sources. If the position of a source corresponds to the regular case, the source will move on the intended path, either with the Cader or automatically. In the compensation case, however, the backward movement of the source is subject to a special case. For describing this special case, the path of a source is divided into the source path 15*a* and the compensation path 15*b*, the default sector representing part of the source path 15*a*, and the compensation sector in FIG. 10*a* representing the compensation path. The default sector corresponds to the original programmed section of the path of the source. The compensation sector describes the path section deviating from the programmed movement.

If the source is moved backward with the Cader, this will have different effects depending on whether the source is located on the compensation sector or on the default sector. If it is assumed that the source is located on the compensation sector, a leftward movement of the Cader will lead to a backward movement of the source. As long as the source is still on the compensation sector, everything happens as expected. However, as soon as the source leaves the compensation sector and enters the default sector, what happens is that the source moves perfectly normally on the default sector but the compensation sector is recalculated to the effect that, when the Cader is again moved to the right, the source will not initially run along the default sector again but will approach the current destination directional zone directly via the recalculated compensation sector. This situation is illustrated in FIG. 10*b*. By moving a source backward and then forward again, a modified compensation sector will be calculated when a default sector is shortened by the backward movement.

In the following, the calculation of the position of a source will be illustrated. A, B and C are the directional zones by means of which the position of a source is defined. A, B and FadeAB describe the start position of the compensation sector. C and FadeAbC describe the position of the source on the compensation sector. FadeAC describes the position of the source on the overall path.

What is sought for is a source positioning wherein the cumbersome input of two values for FadeAB and FadeAbC is dispensed with. Instead, the source is to be set directly via a FadeAC. If FadeAC is set equal to zero, the source is to be at the beginning of the path. If FadeAC is set equal to 1, then source is to be positioned at the end of the path. Furthermore, it is to be avoided that the user be "bothered" with compensation sectors or default sectors during the input. On the other hand, setting the value for FadeAC is dependent on whether the source is located on the compensation sector or on the default sector. As a rule, the equation described at the top of FIG. 10*c* shall apply to FadeAC.

One might come up with the idea of defining the position of a source on the current path section by unambiguously indicating the FadeAC value. FIG. 10*c* shows some examples of how FadeAB and FadeAbC will behave when FadeAC is set.

The following is a description of what happens when FadeAC is set to 0.5. What is happening in detail depends on whether the source is located on the compensation sector or on the default sector. If the source is located on the default sector, the following will be true:

FadeAbC=zero.

If, however, the source is located at the end of the default sector or at the beginning of the compensation sector, respectively, the following is true:

FadeAbC=zero and (FadeAC=FadeAB/FadeAB+1).

FIG. 10*d* shows the determination of the parameters FadeAB and FadeAbC as a function of FadeAC, a differentiation being made in items 1 and 2 as to whether the source is located on the default sector or on the compensation sector, and in item 3 the values for the default sector being calculated, whereas in item 4 the values for the compensation sector are calculated.

The fading factors obtained according to FIG. 10*d* are then, as has been illustrated by FIG. 3*b*, used by the means for calculating the weighting factors so as to finally calculate the weighting factors $g_1$, $g_2$, $g_3$ from which, in turn, the audio signals and interpolations etc. may be calculated, as has been described with respect to FIG. 6.

The inventive concept may be particularly well combined with wave-field synthesis. In one scenario, in which for optical reasons no wave-field synthesis speaker arrays may be placed on the stage and where, instead, delta stereophony with directional groups must be used so as to achieve sound localization, it is typically possible to place wave-field synthesis arrays at least at the sides of the auditorium and at the back of the auditorium. According to the invention, however, a user need not deal with whether a source is henceforth made audible by means of a wave-field synthesis array or a directional group.

An appropriate mixed scenario is also possible when, for example, wave-field synthesis speaker arrays are not possible in a certain area of the stage as they would interfere with the optical impression, whereas in another area of the stage wave-field synthesis speaker arrays may quite possibly be employed. Here, too, a combination of delta stereophony and wave-field synthesis takes place. According to the invention, however, the user will not have to deal with how his/her source is processed since the graphical user interface also provides such areas as directional groups where wave-field synthesis speaker arrays are arranged. On the part of the system for conducting a performance, the directional zone mechanism for positioning is provided such that, in a common user interface, the allocation of sources to wave-field synthesis or to delta stereophony directional sonication may take place without any user intervention. The concept of the directional zones may be universally applied, the user positioning sound sources in the same manner. In other words, the user does not see whether he/she positions a sound source in a directional zone comprising a wafer synthesis array or whether he/she positions a sound source in a directional zone actually having a support speaker which operates in accordance with the principle of the first wave front.

A source movement is effected by the very fact that the user provides movement paths between the directional zones, this movement path set by the user being received by the means for receiving the source path according to FIG. 8. It is only on the part of the configuration system that a respective conversion decides whether a wave-field synthesis source or a delta stereophony source is to be processed. This decision is made, in particular, by investigating a property parameter of the directional zone.

Here, each directional zone may contain any number of speakers and exactly one wave-field synthesis source retained at a fixed position within the speaker array and/or relative to the speaker array by means of its virtual position, and corresponds, as far as that goes, to the (real) position of the support speaker in a delta stereophony system. The wave-field synthesis source then represents a channel of the wave-field synthesis system, it being possible in a wave-field synthesis system, as is known, to process one separate audio object, i.e. one separate source, per channel. The wave-field synthesis source is characterized by appropriate wave-field synthesis-specific parameters.

The movement of the wave-field synthesis source may be effected in two ways, depending on the computing power made available. The fixedly positioned wave-field synthesis sources are triggered by means of fade-over. If a source moves out of a directional zone, the speakers will be attenuated, whereas the speakers of the directional zone the source is moving into will increasingly be attenuated to a lesser extent.

Alternatively, a new position may be interpolated for the input fixed positions, which is then actually made available to a wave-field synthesis renderer as a virtual position, so that a virtual position is created without fade-over and by means of a real wave-field synthesis, which is, of course, not possible in directional zones operating on the basis of delta stereophony.

The present invention is advantageous in that free positioning of sources and allocations to the directional zones may be effected, and that, in particular when there are overlapping directional zones, i.e. when speakers belong to several directional zones, a large number of directional zones with high resolution in terms of directional zone positions may be achieved. In principle, based on the allowed overlap, each speaker on the stage could represent a directional zone of its own which has speakers arranged around it which emit with a larger delay so as to meet the loudness requirements. However, as soon as other directional zones are involved, these (surrounding) speakers will suddenly become support speakers and will no longer be "auxiliary speakers".

The inventive concept is further characterized by an intuitive operator interface relieving the user from as much work as possible and therefore enabling safe operation even by users who are not experts in all details of the system.

Furthermore, a combination of wave-field synthesis with delta stereophony is achieved via a common operator interface, in advantageous embodiments dynamic filtering with source movements being achieved due to the equalization parameters, and a switchover being made between two fade algorithms so as to avoid the generation of artefacts due to the transition from one directional zone to the next directional zone. Moreover, the invention ensures that there will be no dips in the level during fading between the directional zones, dynamic fading further being provided to reduce further artefacts. The provision of a compensation path therefore enables a live application suitability as henceforth there will be possibilities of intervention so as to react, for example, during tracking of sounds when a protagonist leaves the specified path that was programmed.

The present invention is particularly advantageous in the sonication in theaters, stages for performances of musicals, open-air stages and most major auditoriums or concert sites.

Depending on the conditions, the inventive method may be implemented in hardware or in software. The implementation may be effected on a digital storage medium, in particular a disc or a CD with electronically readable control signals that may cooperate with a programmable computer system such that the method is performed. In general, the invention therefore also consists in a computer program product comprising a program code, stored on a machine-readable carrier, for performing the inventive method, when the computer program product runs on a computer. In other words, the invention may therefore be realized as a computer program comprising a program code for performing the method, when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for controlling a plurality of speakers, wherein the speakers are grouped in directional groups, wherein a first directional group position is associated with a first directional group, wherein a second directional group position is associated with a second directional group, wherein a speaker is associated with the first and second directional groups, and wherein the speaker has associated with it a speaker parameter comprising a first parameter value for the first directional group and comprising a second parameter value for the second directional group, comprising:

a provider for providing a source position of an audio source, wherein the source position is located between the first directional group position and the second directional group position; and a calculator for calculating a speaker signal for the at least one speaker, based on the first parameter value for the speaker parameter and the second parameter value for the speaker parameter and the audio signal for the audio source.

2. The apparatus of claim 1, wherein the calculator for calculating a speaker signal is further adapted to calculate the speaker signal on the basis of a measure of direction, which depends on a distance of the source position from the first directional group position and/or the second directional group position.

3. The apparatus of claim 1, wherein the speaker parameter is a delay parameter, a scale parameter or a filter parameter, which is fixedly associated with the at least one speaker.

4. The apparatus of claim 1, wherein the calculator is adapted to interpolate between the first parameter value and the second parameter value, depending on the measure of direction, or to fade over between the first parameter value and the second parameter value, in dependence on the measure of direction.

5. The apparatus of claim 4, wherein the audio source is movable, wherein the provider is adapted to provide a current source position based on source movement information, and which further comprises a controller adapted to control the calculator for calculating a speaker signal depending on a speed of the movement so that either an interpolation or a fading over is performed, or that a weighted mix of the interpolation and the fading over is performed so as to achieve the speaker signal.

6. The apparatus of claim 5, wherein the controller is adapted to use a result of an interpolation with a movement less than a threshold value and use a result of a fading over with a movement greater than a threshold value.

7. The apparatus of claim 1, wherein the calculator is adapted to filter the audio signal with an allpass filter, wherein there is further provided a feeder for feeding the allpass filter with audio signals of two different delays, which depend on an interpolated delay, which depends on an interpolation of delay values associated with the one speaker for the several directional zones.

8. The apparatus of claim 1, wherein the calculator is adapted to perform a fading over, wherein the calculator comprises:

a provider for providing the audio signal with a delay according to the first parameter value and for providing the audio signal with a delay according to the second parameter value;

a weighter for weighting the audio signal, which is delayed according to the first parameter value, with a first weighting factor and for weighting the audio signal, which is delayed according to the second parameter value, with a second weighting factor, wherein the weighting factors depend on a measure of distance; and a summer for summing the weighted audio signals so as to achieve a fading-over audio signal.

9. The apparatus of claim 1, wherein the speaker parameter comprises an equalizer setting, and wherein the calculator further comprises:

a first equalizer for filtering the audio signal with a first equalizer setting according to the first parameter;

a second equalizer for filtering the audio signal with a second equalizer setting according to the second parameter value;

a weighter for weighting a respective audio signal prior to or after the filtering according to weighting factors, which depend on the measure of distance; and a summer for summing weighted and filtered signals.

10. The apparatus of claim 6, wherein the calculator comprises:

a control data manipulator adapted to complete, when a delay alteration changes to a value greater than a switchover threshold value, a just performed fading over first and only then perform a delay interpolation.

11. The apparatus of claim 1, further comprising:

a level monitor for measuring a level due to an audio source at a speaker or a level due to a group of speakers in a directional zone or a level due to a source in all directional zones in which this source is active.

12. The apparatus of claim 1, wherein a further directional group comprises speakers from a wave field synthesis array, wherein the apparatus further comprises:

a wave field synthesis renderer for controlling the speakers of the further directional group due to a position of an audio source; and a determiner for determining, due to a position of the audio source, if the audio source is to be processed by the wave field synthesis renderer.

13. The apparatus of claim 1, further comprising:

a graphic user interface comprising the directional group positions within the reproduction environment displayable thereon;

an inputter for inputting a movement line for a source between two directional group positions or for inputting a movement parameter; and wherein the calculator is adapted to determine a position at one point in time due to the movement line input and the movement parameter input.

14. The apparatus of claim 1, wherein the provider is adapted to provide source positions for several audio sources, wherein the calculator is adapted to calculate a single speaker signal for one source for the at least one speaker, and wherein the apparatus further comprises a summer for the at least one speaker so as to sum the individual speaker signals originating from different audio sources so as to achieve a speaker signal which is reproduced by the one speaker.

15. A method for controlling a plurality of speakers, wherein the speakers are grouped in directional groups, wherein a first directional group position is associated with a first directional group, wherein a second directional group position is associated with a second directional group, wherein a speaker is associated with the first and second directional groups, and wherein the speaker has associated with it a speaker parameter comprising a first parameter value for the first directional group and comprising a second parameter value for the second directional group, comprising:

providing a source position of an audio source, wherein the source position is located between the first directional group position and the second directional group position; and calculating a speaker signal for the at least one speaker, based on the first parameter value for the speaker parameter and the second parameter value for the speaker parameter and the audio signal for the audio source.

16. A non-transitory computer readable medium storing a computer program, when run on a computer, the computer program performs a method of controlling a plurality of speakers, wherein the speakers are grouped in directional groups, wherein a first directional group position is associated with a first directional group, wherein a second directional group position is associated with a second directional group, wherein a speaker is associated with the first and second directional groups, and wherein the speaker has associated with it a speaker parameter comprising a first parameter value for the first directional group and comprising a second parameter value for the second directional group, comprising:

providing a source position of an audio source, wherein the source position is located between the first directional group position and the second directional group position; and calculating a speaker signal for the at least one speaker, based on the first parameter value for the speaker parameter and the second parameter value for the speaker parameter and the audio signal for the audio source.

* * * * *